US009360824B2

(12) United States Patent
Fukao et al.

(10) Patent No.: US 9,360,824 B2
(45) Date of Patent: Jun. 7, 2016

(54) IMAGE FORMING APPARATUS AND PROCESS CARTRIDGE

(71) Applicants: Tomohiro Fukao, Osaka (JP); Tsuyoshi Nozaki, Osaka (JP); Yoshihiro Mikuriya, Hyogo (JP); Yoshimichi Ishikawa, Hyogo (JP); Atsushi Yamamoto, Osaka (JP); Kazuoki Fuwa, Hyogo (JP); Tomoharu Miki, Osaka (JP); Naoki Nakatake, Hyogo (JP); Takeshi Yamashita, Osaka (JP); Tetsushi Sakuma, Chiba (JP)

(72) Inventors: Tomohiro Fukao, Osaka (JP); Tsuyoshi Nozaki, Osaka (JP); Yoshihiro Mikuriya, Hyogo (JP); Yoshimichi Ishikawa, Hyogo (JP); Atsushi Yamamoto, Osaka (JP); Kazuoki Fuwa, Hyogo (JP); Tomoharu Miki, Osaka (JP); Naoki Nakatake, Hyogo (JP); Takeshi Yamashita, Osaka (JP); Tetsushi Sakuma, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/791,658

(22) Filed: Jul. 6, 2015

(65) Prior Publication Data

US 2016/0033924 A1 Feb. 4, 2016

(30) Foreign Application Priority Data

Jul. 31, 2014 (JP) ..... 2014-156700

(51) Int. Cl.
*G03G 21/00* (2006.01)

(52) U.S. Cl.
CPC ..... *G03G 21/0011* (2013.01)

(58) Field of Classification Search
CPC ..... G03G 21/0011; G03G 21/0017; G03G 21/0035; G03G 21/105; G03G 2215/0119; G03G 2215/0129; G03G 5/0539; G03G 5/142; G03G 5/144; G03G 5/14704; G03G 5/14708; G03G 5/14726; G03G 5/0525
See application file for complete search history.

(56) References Cited

U.S. PATENT DOCUMENTS

| | | | | |
|---|---|---|---|---|
| 2005/0214668 | A1* | 9/2005 | Miyakawa | G03G 9/0827 430/108.7 |
| 2006/0285898 | A1 | 12/2006 | Watanabe et al. | |
| 2007/0217842 | A1 | 9/2007 | Kato et al. | |
| 2007/0218358 | A1* | 9/2007 | Kato | H01M 2/0235 429/223 |
| 2007/0218383 | A1 | 9/2007 | Seshita et al. | |
| 2007/0248900 | A1* | 10/2007 | Yabe | G03G 9/0815 430/45.51 |
| 2008/0175630 | A1 | 7/2008 | Yasunaga et al. | |
| 2008/0176159 | A1 | 7/2008 | Matsumoto et al. | |
| 2008/0227009 | A1 | 9/2008 | Fuwa et al. | |
| 2009/0052952 | A1 | 2/2009 | Katoh et al. | |

(Continued)

FOREIGN PATENT DOCUMENTS

| | | |
|---|---|---|
| JP | 8-313487 | 11/1996 |
| JP | 2007-248912 | 9/2007 |
| JP | 2010-210879 | 9/2010 |

*Primary Examiner* — Roy Y Yi
(74) *Attorney, Agent, or Firm* — Oblon, McClelland, Maier & Neustadt, L.L.P.

(57) ABSTRACT

An image forming apparatus is provided which includes an image bearer, a charger, an irradiator, a developing device to develop an electrostatic latent image on the image bearer with a toner to form a toner image, a transfer device to transfer the toner image onto a transfer medium, and a cleaner to remove toner particles remaining on the image bearer without being transferred. The toner includes a mother particle including a binder resin and a colorant and one or more external additives. At least one of the external additives includes primary particles having a number average particle diameter in the range of 0.05 to 0.30 μm. The cleaner includes an elastic body blade having a contact part with the image bearer. The contact part has a surface elastic modulus in the range of 15 to 25 N/mm$^2$ and a surface friction coefficient in the range of 0.5 to 0.7.

10 Claims, 4 Drawing Sheets

(56) References Cited

U.S. PATENT DOCUMENTS

| | | | | |
|---|---|---|---|---|
| 2009/0154971 | A1* | 6/2009 | Itoh | G03G 9/0819 399/350 |
| 2009/0220879 | A1 | 9/2009 | Matsumoto et al. | |
| 2009/0232542 | A1 | 9/2009 | Yamamoto et al. | |
| 2009/0297975 | A1 | 12/2009 | Ishikawa et al. | |
| 2009/0297976 | A1 | 12/2009 | Yamamoto et al. | |
| 2010/0055603 | A1 | 3/2010 | Nozaki et al. | |
| 2011/0045401 | A1 | 2/2011 | Murakami et al. | |
| 2012/0033982 | A1 | 2/2012 | Kubota et al. | |
| 2014/0051019 | A1 | 2/2014 | Sekiguchi et al. | |
| 2014/0065534 | A1 | 3/2014 | Amemori et al. | |
| 2014/0147779 | A1 | 5/2014 | Fuwa et al. | |
| 2014/0147780 | A1 | 5/2014 | Nozaki et al. | |
| 2014/0301757 | A1 | 10/2014 | Sakashita et al. | |
| 2014/0342283 | A1 | 11/2014 | Yamamoto et al. | |
| 2014/0356774 | A1 | 12/2014 | Miki et al. | |
| 2015/0003852 | A1 | 1/2015 | Yamashita et al. | |
| 2015/0078790 | A1 | 3/2015 | Ishikawa et al. | |

* cited by examiner

IMAGE FORMING APPARATUS AND PROCESS CARTRIDGE

CROSS-REFERENCE TO RELATED APPLICATIONS

This patent application is based on and claims priority pursuant to 35 U.S.C. §119(a) to Japanese Patent Application No. 2014-156700, filed on Jul. 31, 2014, in the Japan Patent Office, the entire disclosure of which is hereby incorporated by reference herein.

BACKGROUND

1. Technical Field

The present disclosure relates to an image forming apparatus and a process cartridge.

2. Description of the Related Art

An electrophotographic image forming apparatus, such as copier, printer, and facsimile machine, forms an electrostatic latent image on an image bearer and develops it into a visible image with a developer to obtain a recorded image. A dry developing device that uses powdery toner as the developer (or a part of the developer) is widely employed for use in electrophotographic image forming apparatuses.

Recently, full-color electrophotographic image forming apparatuses have been widely spread and digital images have become more easily available. In view of this situation, printed images are required to have higher definition.

To improve resolution and gradation of the images, various attempts have been made to make toner that visualizes electrostatic latent image have a spherical shape and a smaller particle diameter. Toners produced by pulverization methods have limitations in shape and size. On the other hand, toners produced by polymerization methods, such as suspension polymerization, emulsion polymerization, and dispersion polymerization, are capable of having a spherical shape and a small particle diameter.

In the cleaning process in electrophotography, a cleaner is generally used which is composed of a blade member formed of a platy urethane-rubber, etc., and a supporting member to which the blade member is attached in a longitudinal direction. One end of the blade opposite to the end attached to the supporting member is in contact with the surface of the image bearer at a predetermined pressure. The blade member slidably abrades the surface of the image bearer at a blade nip part formed therebetween while undergoing elastic deformation. As the surface of the image bearer is slidably abraded, toner particles or foreign substances remaining thereon are removed and collected. Such a method of cleaning image bearer is generally widely known as blade cleaning method.

SUMMARY

In accordance with some embodiments of the present invention, an image forming apparatus is provided. The image forming apparatus includes an image bearer, a charger to charge a surface of the image bearer, an irradiator to irradiate the charged surface of the image bearer with light to form an electrostatic latent image thereon, a developing device to develop the electrostatic latent image with a toner to form a toner image, a transfer device to transfer the toner image onto a transfer medium, and a cleaner to remove toner particles remaining on the image bearer without being transferred. The toner includes a mother particle including a binder resin and a colorant, and one or more external additives. At least one of the external additives includes primary particles having a number average particle diameter in the range of 0.05 to 0.30 μm. The cleaner includes an elastic body blade. The elastic body blade has a contact part with the image bearer, and the contact part has a surface elastic modulus in the range of 15 to 25 N/mm$^2$ and a surface friction coefficient in the range of 0.5 to 0.7.

In accordance with some embodiments of the present invention, a process cartridge is provided. The process cartridge includes an image bearer and at least one member selected from: a charger to charge a surface of the image bearer; a developing device to develop an electrostatic latent image formed by irradiating the charged surface of the image bearer with a toner to form a toner image; and a transfer device to transfer the toner image onto a transfer medium. Here, the toner includes a mother particle including a binder resin and a colorant and one or more external additives, and at least one of the external additives includes primary particles having a number average particle diameter in the range of 0.05 to 0.30 μm. The process cartridge further includes a cleaner to remove toner particles remaining on the image bearer without being transferred. The cleaner includes an elastic body blade. The elastic body blade has a contact part with the image bearer, and the contact part has a surface elastic modulus in the range of 15 to 25 N/mm$^2$ and a surface friction coefficient in the range of 0.5 to 0.7.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
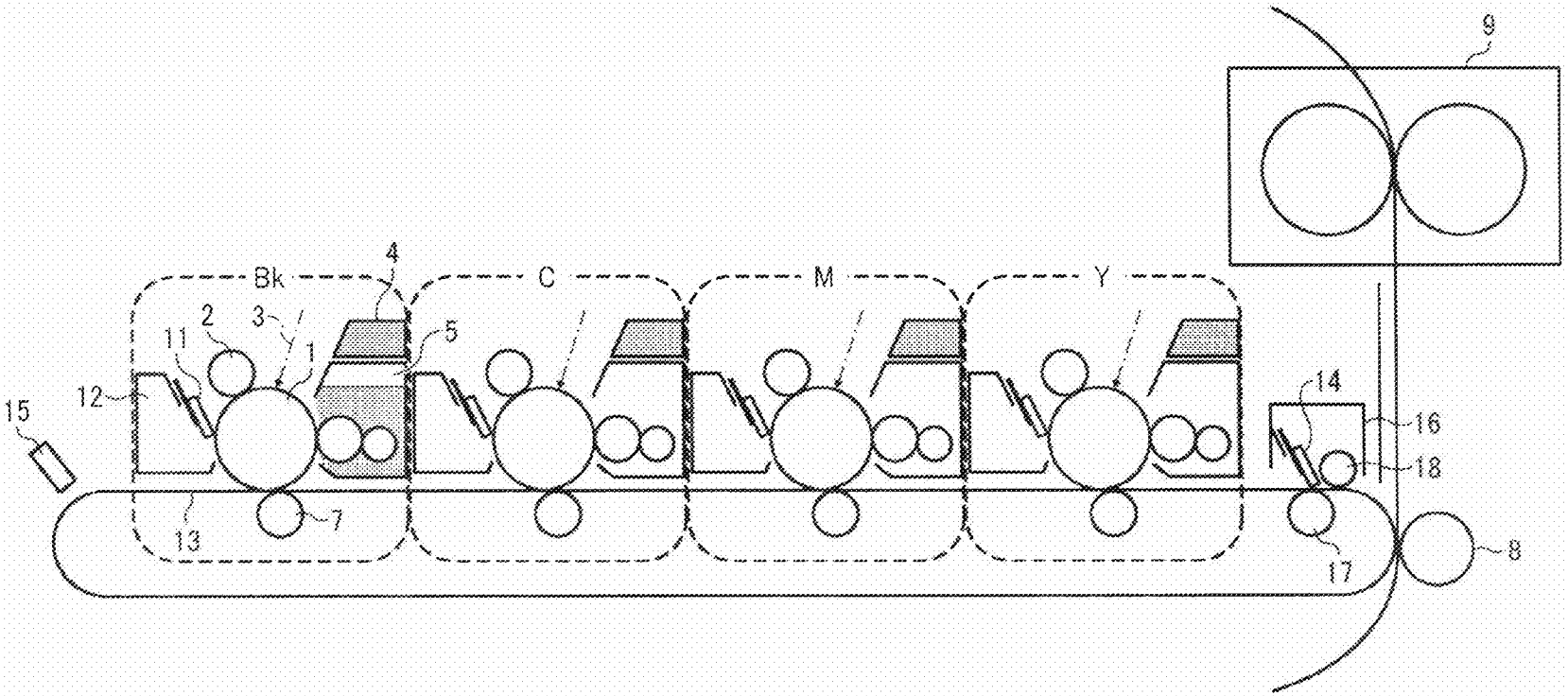
FIG. 1 is a schematic view of an image forming apparatus according to an embodiment of the present invention.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

The inventors of the present invention have found that cleanability and abrasion of photoconductor (image bearer) are dominantly influenced by the elastic modulus and surface friction coefficient at the very surface of the cleaning blade. Even when an elastic body blade is specified in terms of impact resilience coefficient, in the case where the blade is covered with a surface layer which is harder than the tip edge line, only the properties of the surface layer exert influence on cleaning ability.

In light of the above-described situation, one object of the present invention is to provide an image forming apparatus which provides high-quality image while preventing the occurrence of defective cleaning under various usage environments.

In accordance with some embodiments of the present invention, an image forming apparatus which provides high-quality image while preventing the occurrence of defective cleaning under various usage environments is provided.

In accordance with some embodiments of the present invention, the image forming apparatus includes: an image bearer; a charger to charge a surface of the image bearer; an irradiator to irradiate the charged surface of the image bearer with light to form an electrostatic latent image thereon; a developing device to develop the electrostatic latent image with a toner to form a toner image; a transfer device to transfer the toner image onto a transfer medium; and a cleaner to remove toner particles remaining on the image bearer without being transferred. The toner includes a mother particle including a binder resin and a colorant, and one or more external additives. At least one of the external additives includes primary particles having a number average particle diameter in the range of 0.05 to 0.30 μm. The cleaner includes an elastic body blade having a contact part with the image bearer. The contact part has a surface elastic modulus in the range of 15 to 25 N/mm$^2$ and a surface friction coefficient in the range of 0.5 to 0.7.

The cleaner includes an elastic body blade, and the elastic body blade has a contact part with the image bearer. The contact part has a surface elastic modulus in the range of 15 to 25 N/mm$^2$ and a surface friction coefficient in the range of 0.5 to 0.7. Such a cleaner reduces frictional force with the image bearer and suppresses vibration under various usage environments, thereby rigidly forming an accumulation layer to suppress defective cleaning.

Additionally, the toner includes an external additive (e.g., silica) including primary particles having a number average particle diameter in the range of 0.05 to 0.30 μm. Such a toner prevents generation of defective image in solid image, which may be caused by the occurrence of filming phenomena in that the external additives disadvantageously form a thin film thereof on the image bearer.

In removing toner particles from the image bearer, it is necessary that an accumulation layer of the toner and external additives be formed at an upstream vicinity of the nip formed between the elastic body blade and the image bearer.

In cleaning the image bearer with the elastic body blade, it is necessary that an accumulation layer be formed at an upstream side from the contact part with the image bearer. To achieve the formation of an accumulation layer, the elastic body blade and the image bearer are required to be in stable and constant contact.

By adjusting the elastic body blade to have a surface elastic modulus in the range of 15 to 25 N/mm$^2$ and a surface friction coefficient in the range of 0.5 to 0.7 at a contact part with the image bearer, defective cleaning and adherence of the external additives to the image bearer can be suppressed. The elastic body blade provides another effect of scraping off micro aggregations of the external additives adhered to the image bearer.

By adjusting the surface friction coefficient to be in the specified range, stable contact of the elastic body blade with the image bearer can be achieved under various environments. When the surface friction coefficient exceeds 0.7, the elastic body blade may repeat following and returning motions to cause micro vibration at the contact part with the image bearer in the direction of rotation of the image bearer, which is not preferable. When the surface friction coefficient falls below 0.5, the elastic body blade may slip at the contact part with the image bearer to cause defective cleaning, which is not preferable. In addition, the elastic body blade may slip over micro aggregations of the external additives adhered to the image bearer without scraping them off, which is not preferable.

The elastic body blade changes its elastic modulus depending on temperature and humidity, thereby changing cleanability. By adjusting the surface elastic modulus to be in the specified range, environmental fluctuation depending on temperature and humidity can be reduced and the stable contact of the elastic body blade with the image bearer can last for an extended period of time.

Because the elastic body blade is in constant contact with the image bearer, it is unavoidable that the elastic body blade is abraded after a long-term use. It is confirmed by the inventors of the present invention that defective cleaning can occur when the contact of the elastic body blade with the image bearer becomes insufficient due to abrasion of the elastic body blade.

When the surface elastic modulus falls below 15 N/mm$^2$, the amount of abrasion of the elastic body blade may become large, causing defective cleaning and adherence of the external additives to the image bearer, which is not preferable. In addition, the contact of the elastic body blade with the image bearer may become uneven, causing defective cleaning and adherence of the external additives to the image bearer at a part where the contact pressure is low, which is not preferable. Moreover, when the contact pressure is high, the image bearer may be significantly abraded causing streaky abnormal image, which is not preferable. When the surface elastic modulus exceeds 25 N/mm$^2$, the elastic body blade may slip over aggregations of the external additives adhered to the image bearer without removing them, which is not preferable.

The inventors of the present invention have also found that when the amount of incoming toner or external additives for forming an accumulation layer at an upstream side of the contact part (i.e., the amount of toner removed at the contact part) is extremely small, only adjusting the surface elastic modulus and surface friction coefficient to be in the specified ranges is insufficient. There is a case in which defective cleaning occurs when the amount of incoming toner or external additives becomes relatively large after a long period during which supply of the toner or external additive to an upstream side from the contact part is extremely small.

The inventors of the present invention have found that when the toner includes an external additive including primary particles having a number average particle diameter in the range of 0.05 to 0.30 μm, high-quality image is produced without causing defective cleaning for an extended period of time. This is because the external additive including primary particles having a number average particle diameter in the range of 0.05 to 0.30 μm (e.g., large-particle-diameter silica) has a low adhesive force due to its large particle diameter, and therefore is constantly supplied to an upstream side of the contact part of the elastic body blade with the image bearer to rigidly form an accumulation layer of the external additive and toner. Even when adherence of the external additive occurs, the rigid accumulation layer including the external additive including primary particles having a number average particle diameter in the range of 0.05 to 0.30 μm scrape them off without causing defective image.

When the number average particle diameter of primary particles is less than 0.05 μm, defective cleaning and adherence of the external additives may occur, which is not preferable.

When the number average particle diameter of primary particles is in excess of 0.03 μm, the toner flowability may become too low for the toner to provide toner functions, which is not preferable. In addition, formation of an accumulation layer may not be achieved for an extended period of time because of the extremely low adhesive force, and external additive particles having a particle diameter larger than 0.30 μm may contaminate members to cause abnormal image, which is not preferable.

Accordingly, a combination of the elastic body blade having specific surface elastic modulus and surface friction coefficient and an external additive including primary particles having a number average particle diameter in the range of 0.05 to 0.30 μm constantly and rigidly forms an accumulation layer at an upstream side from the contact part of the elastic body blade with the image bearer, to provide remarkable effect for preventing the occurrence of defective cleaning and adherence of the external additives to the image bearer under various environments for an extended period of time.

Image Forming Apparatus

FIG. 1 is a schematic view of an image forming apparatus according to an embodiment of the present invention. The image forming apparatus illustrated in FIG. 1 is a tandem-type image forming apparatus.

Around the drum-shaped photoconductor 1 serving as the image bearer, the following members are provided in the following order: a charger 2 to charge a surface of the photoconductor 1, a laser light beam 3 emitted from an irradiator to form an electrostatic latent image on the charged surface of the photoconductor 1, a developing device 5 to supply charged toner to the latent image on the surface of the photoconductor 1 to develop it into a toner image, a transfer device 7 to transfer the toner image from the surface of the photoconductor 1 onto a transfer member (transfer belt 13), and a cleaner 12 to remove residual toner particles remaining on the photoconductor 1. A toner supply container 4 to store toner and supply the toner to the developing device 5 is connected to an upper part of the developing device 5. The toner supply container 4 is replaceable.

In the present embodiment, the toner supply container 4 is configured to feed toner directly to the developing device. Alternatively, the toner supply container 4 may be configured to feed toner to the developing device through a supply path provided in the main body of the image forming apparatus.

In the tandem-type electrophotographic image forming apparatus, a single-color image, such as a black (Bk), cyan (C), magenta (M), or yellow (Y) image, is formed on each photoconductor 1. Referring to FIG. 1, each area enclosed by dotted line represents an image forming unit for each color. When image formation is performed by a negative-positive method in which the potential of the irradiated part is lowered so that toner can adhere thereto, a surface of the photoconductor 1 is uniformly and negatively charged by a charging roller of the charger 2, the charged surface is irradiated with the light beam 3 to form an electrostatic latent image thereon, and the developing device 5 supplies toner to the electrostatic latent image on the photoconductor 1 to form a toner image that is visible.

The toner image is transferred from the surface of the photoconductor 1 onto the transfer belt 13 by the transfer device 7. Residual toner particles remaining on the photoconductor 1 without being transferred onto the transfer belt 13 are removed by a cleaning blade 11 of the cleaner 12.

The toner image transferred onto the transfer belt 13 is further transferred onto a recording paper fed from a paper feeding tray at a secondary transfer part upon application of a bias to a secondary transfer roller 8.

Residual toner particles and external additives remaining on the transfer belt 13 after the secondary transfer are removed by a transfer belt cleaner 16. The transfer belt cleaner 16 is equipped with a cleaning facing roller 17 that is metallic, a transfer belt cleaning blade 14 in contact with the transfer belt 13 so as to face in the direction of movement of the transfer belt 13, and a collecting roller 18. The transfer belt cleaner 16 removes residual toner particles and external additives remaining on the transfer belt 13. The removed toner particles and external additives are stored in a waste toner storage.

The toner image transferred onto the recording paper is fixed thereon by a fixing device 9. The fixed image is ejected from a paper ejection spout.

A sensor 15 that measures the amount of toner transferred onto the transfer belt 13 and the position of each color image for adjusting image density and position is provided near the transfer belt 13. The sensor 15 combines a regular reflection method and a diffuse reflection method.

Process Cartridge

Figure 2:
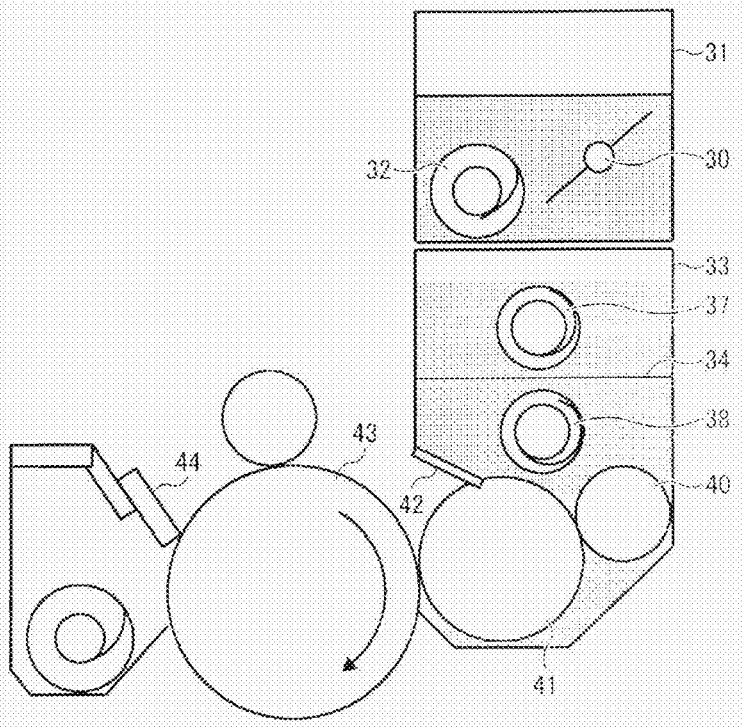
FIG. 2 is a schematic view of a process cartridge according to an embodiment of the present invention.
Figure 3:
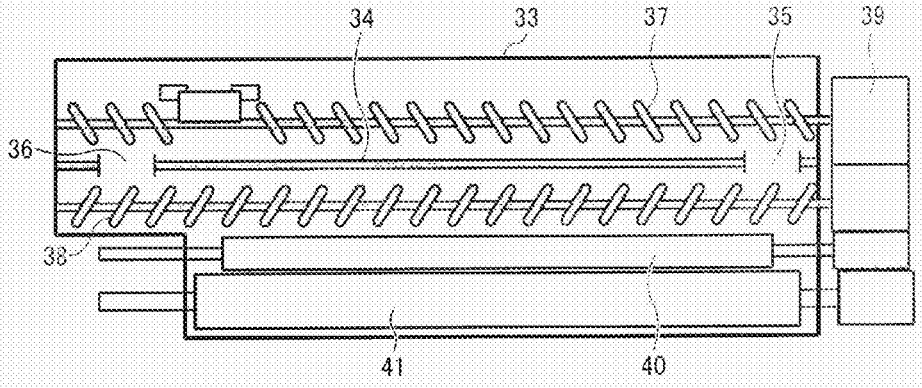
FIG. 3 is a schematic cross-sectional view of a developing device illustrated in FIG. 2.

FIG. 2 is a schematic view of a process cartridge according to an embodiment of the present invention. FIG. 3 is a schematic cross-sectional view of a developing device illustrated in FIG. 2.

A developing device 33 is connected to a toner container 31. Within the toner container 31, a stirring paddle 30 constantly stirs toner so that the toner can maintain flowability. Within the toner container 31, a conveyer 32, such as a screw and a coil, is provided. The conveyer 32 conveys toner toward a toner supply opening provided at a connection part with the developing device or image forming apparatus through a toner supply path. The following description is based on a case where toner is directly supplied to the developing device. The conveyer 32 is connectable to a main body driver. Connection or disconnection is controlled by known means such as clutch, thereby controlling toner supply drive.

The amount of toner supply can be controlled by the driving time of the driver. For example, the driving time can be changed in accordance with change in toner flowability depending on temperature and humidity.

Within the developing device 33, a dividing plate 34 is provided in an axial direction relative to a developing member 41. The dividing plate 34 divides the inside of the developing device 33 into an upper chamber and a lower chamber. The dividing plate 34 has at least openings 35 and 36 on its both longitudinal ends to make toner movable between the upper chamber and the lower chamber. Toner supplied from the toner container 31 to the developing device 33 is conveyed by a first toner conveyer 37 (e.g., screw) disposed in the upper chamber in an axial direction relative to the developing member 41. The toner then moves to the lower chamber through the opening on a downstream side relative to the direction of conveyance of toner. The toner is then conveyed by a second toner conveyer 38 (e.g., screw) disposed in the lower chamber in the direction opposite to the axial direction that the first toner conveyer 37 conveys the toner. The toner is movable to the upper chamber through the opening on a downstream side from the second toner conveyer 38. Thus, toner is capable of circulating within the developing device 33 in a longitudinal direction.

The toner conveyance speed is controllable by the configuration of the conveyer. When the conveyer is a screw, the toner conveyance speed is in proportional to the screw pitch. This is because the amount of toner conveyed per rotation is increased in accordance with the screw pitch. The toner conveyance speed is also controllable by controlling the screw diameter.

A drive transmitter 39, composed of a gear, a coupling, etc., transmits a drive to the first and second toner conveyers 37 and 38 from a driver disposed in the image forming apparatus main body. Within the developing device 33, a toner supply member 40, composed of a sponge, etc., supplies toner to the developing member 41.

The toner moved onto the developing member 41 by the toner supply member 40 is formed into a uniform toner layer by a regulator 42. The toner in an amount according to the surface potential of a photoconductor drum 43 is moved onto the surface of the photoconductor drum 43, and then transferred onto a transfer medium (transfer belt) by a transfer device. Residual toner particles remaining on the photoconductor drum 43 without being transferred are removed by a cleaner 44 and collected in a waste toner container disposed in the image forming apparatus.

Cleaner

Figure 4:
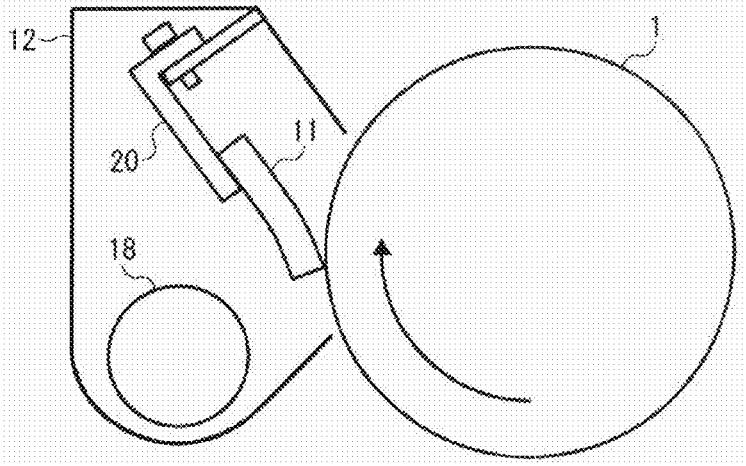
FIG. 4 is a schematic magnified view of a cleaner according to an embodiment of the present invention.
Figure 5:
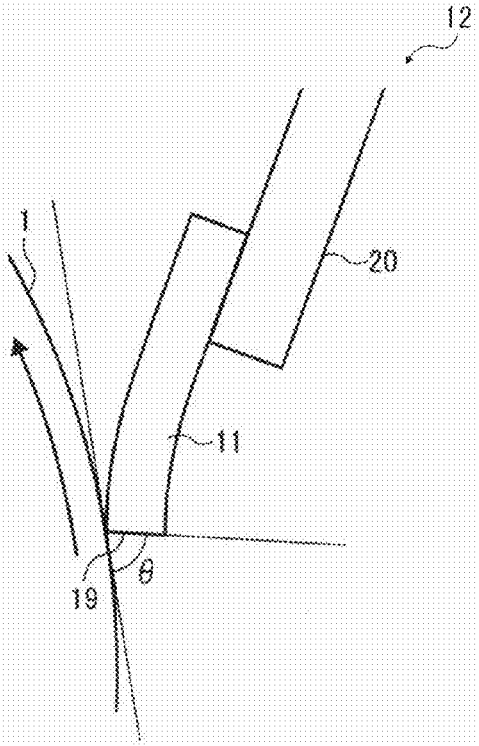
FIG. 5 is a schematic magnified view of the contact part of the cleaner with the photoconductor illustrated in FIG. 4.

FIG. 4 is a schematic magnified view of a cleaner according to an embodiment of the present invention. FIG. 5 is a schematic magnified view of the contact part of the cleaner with the photoconductor illustrated in FIG. 4.

The cleaner 12 is composed of a supporting member 20 formed of a metal such as SUS, and an elastic body blade 11 formed of an elastic material such as polyurethane, attached to the supporting member 20. An edge of the elastic body blade 11 is in contact with the photoconductor 1 so as to face in the direction of rotation of the photoconductor 1, to scrape off toner or other adherences from the surface of the photoconductor 1.

The elastic body blade 11 may be formed of an elastic material such as neoprene rubber, chloroprene rubber, silicone rubber, and acrylic rubber. Preferably, the elastic body blade 11 is formed of polyurethane rubber that will not give chemical damage to photoconductor and is excellent in durability, ozone resistance, and oil resistance. As for rubber hardness, the elastic body blade preferably has a JIS-A hardness in the range of 70° to 85°. When the elastic body blade has a JIS-A hardness in the specified range, the surface elastic modulus can be set to a high value, thereby improving toner scraping property. When the JIS-A hardness is in excess of 85°, the blade becomes poorer in flexibility and is likely to contact the photoconductor unevenly. A uniform contact pressure may not be achieved in the axial direction. When the JIS-A hardness is less than 70°, the tip edge line of the blade may rise up and separate from the photoconductor with the blade contacting the photoconductor at its side surface.

The supporting member 20 is fixed to a casing of the image forming unit with a screw so that an edge of the elastic body blade 11 is brought into contact with the photoconductor 1. When an angle 19 between a tangent line at the contact part of the elastic body blade 11 with the photoconductor 1 (which is parallel to the direction of rotation of the photoconductor 1) and the edge surface of the elastic body blade 11 is from 77° to 82°, the elastic body blade 11 is prevented from making a squeaking noise or turning up.

When the angle 19 falls below 77°, the tip behavior becomes larger at the contact part of the blade edge with the photoconductor and a toner damming layer becomes unstable, thereby causing defective cleaning. There is a high possibility that the defective cleaning causes abnormal image and the blade edge follows the photoconductor to cause turning-up.

When the angle 19 exceeds 82°, the blade edge cannot intimately contact the photoconductor and is likely to contact the photoconductor at its side surface, causing defective cleaning.

The contact pressure of the elastic body blade can be measured by a pressure sensor installed to the surface of the photoconductor. Preferably, the contact pressure is in the range of 30 to 70 N/m. The contact pressure within the specified range is sufficiently large to secure intimate contact of the blade edge with the image bearer (photoconductor).

When the contact pressure falls below 30 N/m, the surface pressure of the elastic body blade becomes too low to provide a sufficient toner blocking power, causing defective cleaning. When the contact pressure exceeds 70 N/m, the surface pressure of the elastic body blade becomes so high that chattering may be caused. Moreover, a photoconductor driving torque becomes so large that a large-capacity motor is required, which is disadvantageous in terms of economic perspective.

The elastic body blade 11 having the specified surface friction coefficient and surface elastic modulus can be obtained by molding a polyurethane material into the form of a strip, subjecting the strip to a dip treatment in an isocyanate-based treatment liquid, removing the solvent by drying, and subjecting the strip to a surface treatment. Alternatively, the dip treatment can be replaced with any known means such as spray coating.

Preferably, the surface friction coefficient is in the range of 0.5 to 0.7. When the surface friction coefficient exceeds 0.7, the tip behavior becomes larger and a toner damming layer becomes unstable because the blade edge contacts the photoconductor with the distance that the blade edge follows in the direction of rotation of the photoconductor being large, thereby causing defective cleaning. When the surface friction coefficient falls below 0.5, the surface pressure of the elastic body blade becomes too low to provide a sufficient toner blocking power, causing defective cleaning.

Preferably, the surface elastic modulus is in the range of 15 to 25 $N/mm^2$.

When the surface elastic modulus falls below 15 $N/mm^2$, sufficient scraping property cannot be obtained at the surface of the photoconductor.

When the surface elastic modulus exceeds 25 $N/mm^2$, the elastic body blade (particularly in the case of a polyurethane blade) increases its hardness under low-temperature environments. This means that the blade becomes brittle to cause the blade edge to be chipped. Moreover, the amount of abrasion of the photoconductor increases to shorten its lifespan. Additionally, the hardness at the blade edge becomes so high that intimate contact with the photoconductor cannot be achieved, allowing toner to pass through the blade.

The surface friction coefficient and surface elastic modulus arc controllable to some degree by adjusting the base material of the elastic body blade 11 (e.g., polyurethane material). In addition, they are controllable by the concentration of the isocyanate-based treatment liquid. As the concentration of the treatment liquid increases, the surface friction coefficient becomes smaller and the surface elastic modulus becomes larger.

Surface Friction Coefficient

In the present disclosure, surface friction coefficient is measured in the following manner.

On an elastic body blade having a strip-like shape, an SUS weight having a weight of 117 gf is put. A small-elastic-deformation material, such as wire, is attached to one end of the weight and a digital force gauge is fixed to the other end. The weight is pulled in a horizontal direction through the small-elastic-deformation material while measuring the tensile force. Surface friction coefficient is calculated from the tensile force with reference to the equation: $F=\mu N$. The values measured 5 to 10 seconds after starting of movement of the weight are averaged, and the averaged value is employed as surface friction coefficient.

Surface Elastic Modulus

In the present disclosure, surface elastic modulus is measured in the following manner.

With respect to an elastic body blade having a strip-like shape, a measurement point is set at a position 30 μm from a leading edge on a surface which contacts a photoconductor. The measurement is performed by a microhardness tester (DUH-211S available from Shimadzu Corporation).

Toner

The toner includes a mother particle including a binder resin and a colorant, and external additives that supplement flowability, developability, chargeability, and the like. The mother particle may further include other components such as a release agent, a charge controlling agent, and a plasticizer.

Binder Resin

Specific examples of the binder resin include, but are not limited to, polyester, polyurethane, polyurea, epoxy resin, and vinyl resin. A hybrid resin in which different resins are chemically bonded can also be used. It is possible to introduce a reactive functional group to a terminal or side chain of the resin molecule and bind them together to cause elongation in the process of producing toner. Each resin can be used alone or in combination. In preparing a toner having projections for the purpose of surface shape control, it is preferable that the projections are formed of a resin different from that forms the main body of the toner particle.

The binder resin, at least in part, is soluble in organic solvents. The binder resin preferably has an acid value in the range of 2 to 24 mgKOH/g. When the acid value is in excess of 24 mgKOH/g, the resin is likely to transfer to an aqueous phase, and as a result, the problem may arise that a mass balance loss is caused in the manufacturing process or that dispersion stability of oil droplets is degraded. Moreover, moisture absorbing property of the toner may increase to degrade charging ability and storage property in high-temperature and high-humidity conditions. When the acid value is less than 2 mgKOH/g, the polarity of the resin is lowered. As a result, it becomes difficult to uniformly disperse a colorant which has a certain degree of polarity in oil droplets.

When the binder resin includes a resin having a polyester skeleton, an electrophotographic toner having excellent fixability can be obtained. The resin having a polyester skeleton may be either a polyester resin or a block copolymer of a polyester resin with another resin having a different skeleton. Polyester resin is more preferred because the resulting mother particle will be higher in uniformity.

Specific examples of the polyester resin include, but are not limited to, ring-opening polymerization products of lactones, polycondensation products of hydroxycarboxylic acids, and polycondensation products of polyols with polycarboxylic acids. In view of the degree of freedom in designing, polycondensation products of polyols with polycarboxylic acids are preferable.

The polyester resin has a peak molecular weight in the range of 1,000 to 30,000, preferably 1,500 to 10,000, and more preferably 2,000 to 8,000. When the peak molecular weight is less than 1,000, heat-resistant storage stability may degrade. When the peak molecular weight is in excess of 30,000, low-temperature fixability may degrade.

The polyester resin has a glass transition temperature in the range of 45° C. to 70° C., preferably 50° C. to 65° C. During transportation, it is assumed that toner or toner cartridge is exposed to a high-temperature and high-humidity environment at 40° C. and 90%. There is a possibility that such a toner is deformed under a certain pressure or toner particles stick together without behaving as a particle. Therefore, the glass transition temperature of less than 45° C. is not preferable. When the glass transition temperature is in excess of 70° C., low-temperature fixability may degrade.

Polyol

A polyol (1) includes a diol (1-1) and a polyol (1-2) having 3 or more valences. A diol (1-1) alone or a mixture of a diol (1-1) with a small amount of a polyol (1-2) having 3 or more valences is preferable.

Specific examples of the diol (1-1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the above-described alicyclic diols; 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (as known as tetrafluorobisphenol A), and 2,2-bis(3-hydroxyphenyl)-1,1,1,3,3,3-hexafluoropropane; bis(4-hydroxyphenyl) ethers such as bis(3-fluoro-4-hydroxyphenyl) ether; and alkylene oxide (e.g., ethylene oxide, propylene oxide, butylene oxide) adducts of the above-described bisphenols.

Among these diols, alkylene glycols having 2 to 12 carbon atoms and alkylene oxide adducts of bisphenols are preferable, and combination use of alkylene oxide adducts of bisphenols with alkylene glycols having 2 to 12 carbon atoms is more preferable.

Specific examples of the polyol (1-2) having 3 or more valences include, but are not limited to, polyvalent aliphatic alcohols having 3 or more valences (e.g., glycerin, trimethylolethane, trimethylolpropane, pentaerythritol, sorbitol); phenols having 3 or more valences (e.g., trisphenol PA, phenol novolac, cresol novolac); and alkylene oxide adducts of the polyphenols having 3 or more valences.

Polycarboxylic Acid

A polycarboxylic acid (2) includes a dicarboxylic acid (2-1) and a polycarboxylic acid (2-2) having 3 or more valences. A dicarboxylic acid (2-1) alone or a mixture of a dicarboxylic acid (2-1) with a small amount of a polycarboxylic acid (2-2) having 3 or more valences is preferable.

Specific examples of the dicarboxylic acid (2-1) include, but are not limited to, alkylene dicarboxylic acids (e.g., succinic acid, adipic acid, sebacic acid), alkenylene dicarboxylic acids (e.g., maleic acid, fumaric acid), aromatic dicarboxylic acids (e.g., phthalic acid, isophthalic acid, terephthalic acid, naphthalenedicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl) hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'- biphenyldicarboxylic acid, and hexafluoroisopropylidene diphthalic acid anhydride. Among these dicarboxylic acids, alkenylene dicarboxylic acids having 4 to 20 carbon atoms and aromatic dicarboxylic acids having 8 to 20 carbon atoms are preferable.

Specific examples of the polycarboxylic acid (2-2) having 3 or more valences include, but are not limited to, aromatic polycarboxylic acids having 9 to 20 carbon atoms (e.g., trimellitic acid, pyromellitic acid). Specific examples of the polycarboxylic acid (2) further include acid anhydrides or lower alkyl esters (e.g., methyl ester, ethyl ester, isopropyl ester) of the above-described compounds.

The equivalent ratio [OH]/[COOH] of hydroxyl groups [OH] in the polyol (1) to carboxyl groups [COOH] in the polycarboxylic acid (2) is typically from 2/1 to 1/2, preferably from 1.5/1 to 1/1.5, and more preferably from 1.3/1 to 1/1.3.

Modified Resin

For the purpose of enhancing mechanical strength and preventing the occurrence of high-temperature offset at the time of fixing, the mother particle may include a modified resin. The mother particle can be prepared by dissolving a modified resin having a terminal isocyanate group in an oily phase. The modified resin can be obtained as follows. For example, a resin having an isocyanate group can be obtained by polymerization of a monomer having an isocyanate. As another example, a polymer having a terminal isocyanate group can be obtained by preparing a polymer having a terminal active hydrogen group by polymerization and introducing an isocyanate group to a polymer terminal by reaction of a polyisocyanate. The latter is more preferable in view of controllability in introducing a terminal isocyanate group. The active hydrogen group includes hydroxyl groups (e.g., alcoholic hydroxyl groups, phenolic hydroxyl groups), amino groups, carboxyl group, and mercapto group. Among these groups, alcoholic hydroxyl groups are most preferable. The modified resin preferably has the same skeleton as the binder resin that is soluble in organic solvents in view of uniformity of the resulting mother particle. Accordingly, the modified resin preferably has a polyester skeleton. A polyester resin having a terminal alcoholic hydroxyl group can be obtained by a polycondensation reaction between a polyol and a polycarboxylic acid, while setting the number of functional groups in the polyol greater than that in the polycarboxylic acid.

Amine Compound

A part of isocyanate groups in the modified resin convert to amino groups by hydrolysis through the process of obtaining mother particles by dispersing an oily phase in an aqueous phase. The produced amino groups then react with unreacted isocyanate groups, thereby progressing an elongation reaction. For the purpose of reliably progressing the elongation reaction or introducing cross-linking points, an amine compound can be used in combination. The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane, tetrafluoro-p-xylylenediamine, tetrafluoro-p-phenylenediamine), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine, dodecafluorohexylenediamine, tetracosafluorododecylenediamine). Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline. Specific examples of the amino mercaptan (B4) include, but are not limited to, aminoethyl mercaptan and aminopropyl mercaptan. Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds. Among these amines (B), a diamine (B1) and a mixture of a diamine (B1) with a polyamine (B2) having or more valences are preferable.

The ratio of the number of amino groups [NHx] in the amine (B) to the number of isocyanate groups [NCO] in a prepolymer (A) having isocyanate groups is 4 or less, preferably 2 or less, more preferably 1.5 or less, and most preferably 1.2 or less. When the ratio exceeds 4, excessive amino groups block the isocyanate groups to prevent the modified resin from elongating. The resulting polyester may have a small molecular weight and poor hot offset resistance.

Organic Solvent

Volatile organic solvents having a boiling point less than 100° C. are preferably used in the process of preparing mother particles because they are easily removable in the later processes. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In a case where a resin to be dissolved or dispersed in an organic solvent has a polyester skeleton, the organic solvent is preferably selected from an ester solvent (e.g., methyl acetate, ethyl acetate, butyl acetate) or a ketone solvent (e.g., methyl ethyl ketone, methyl isobutyl ketone), which has high solubility. In particular, methyl acetate, ethyl acetate, and methyl ethyl ketone are preferable for their high removability.

Aqueous Medium

An aqueous medium may consist of water alone or a combination of water with a water-miscible solvent. Specific examples of usable water-miscible solvents include, but are not limited to, alcohols (e.g., methanol, isopropanol, ethylene glycol), dimethylformamide, tetrahydrofuran, cellosolves (e.g., methyl cellosolve (trademark)), and lower ketones (e.g., acetone, methyl ethyl ketone).

Surfactant

A surfactant is used when an oily phase is dispersed in the aqueous medium to form oil droplets.

Specific examples of the surfactant include, but are not limited to, anionic surfactants such as alkylbenzene sulfonate, α-olefin sulfonate, and phosphates; cationic surfactants such as amine salt surfactants (e.g., alkylamine salts, amino alcohol fatty acid derivatives, polyamine fatty acid derivatives, imidazoline) and quaternary ammonium salt surfactants (e.g., alkyl trimethyl ammonium salts, dialkyl dimethyl ammonium salts, alkyl dimethyl benzyl ammonium salts, pyridinium salts, alkyl isoquinolinium salts, benzethonium chloride); nonionic surfactants such as fatty acid amide derivatives and polyol derivatives; and ampholytic surfactants such as alanine, dodecyldi(aminoethyl)glycine, di(octylaminoethyl)glycine, and N-alkyl-N,N-dimethyl ammonium betaine. Surfactants having a fluoroalkyl group can achieve their effect in small amounts.

Specific preferred examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl (C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16)ethyl phosphates. Specific examples of usable cationic surfactants include, but are not limited to, aliphatic primary, secondary, and tertiary amine acids having a fluoroalkyl group; aliphatic quaternary ammonium salts such as perfluoroalkyl(C6-C10) sulfonamide propyl trimethyl ammonium salts; benzalkonium salts; benzethonium chloride; pyridinium salts; and imidazolinium salts.

Inorganic Dispersant

A solution or dispersion of toner composition may be dispersed in the aqueous medium in the presence of an inorganic dispersant or a fine resin particle. Specific examples of the inorganic dispersant include, but are not limited to, tricalcium phosphate, calcium carbonate, titanium oxide, colloidal silica, and hydroxyapatite. Using the dispersant is preferable because the resulting particle size distribution becomes narrow and the dispersion becomes stable.

Polymeric Protection Colloids

Additionally, polymeric protection colloids are also usable to stabilize dispersing liquid droplets.

Specific examples of usable polymeric protection colloids include, but are not limited to, homopolymers and copolymers of monomers such as acids (e.g., acrylic acid, methacrylic acid, α-cyanoacrylic acid, α-cyanomethacrylic acid, itaconic acid, crotonic acid, fumaric acid, maleic acid, maleic anhydride); acrylic and methacrylic monomers having hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide); vinyl alcohols; vinyl alcohol ethers (e.g., vinyl methyl ether, vinyl ethyl ether, vinyl propyl ether); esters of vinyl alcohols with compounds having carboxyl group (e.g., vinyl acetate, vinyl propionate, vinyl butyrate); acrylamide, methacrylamide, diacetone acrylamide, and methylol compound, thereof; acid chlorides (e.g., acrylic acid chloride, methacrylic acid chloride); and nitrogen-containing compounds or nitrogen-containing heterocyclic compounds (e.g., vinylpyridine, vinylpyrrolidone, vinylimidazole, ethyleneimine). Additionally, polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester) and celluloses (e.g., methyl cellulose, hydroxyethyl cellulose, hydroxypropyl cellulose) are also usable.

In a case in which an acid-soluble or base-soluble substance, such as calcium phosphate, is used as a dispersion stabilizer, the resulting particles may be first washed with an acid (e.g., hydrochloric acid) to dissolve the dispersion stabilizer and then water to wash it away. Alternatively, such a dispersion stabilizer can be removed by being decomposed by an enzyme. The dispersant may remain on the surface of the toner particle. Preferably, in terms of chargeability, the dispersant is washed away from the surface of the toner particle after the elongation and/or cross-linking reaction.

Colorant

Specific examples of usable colorants include dyes and pigments, such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 313, Bordeaux 5B, Toluidine Maroon, PERMANENT BORDEAUX F2K, HELLIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

Colorant Master Batch

The colorant may be combined with a resin to be used as a master batch.

Specific examples of resins usable for the master batch include, but are not limited to, the above-described modified and unmodified polyester resins, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

Preparation of Master Batch

The master batch can be obtained by mixing and kneading a resin and a colorant while applying a high shearing force. To increase the interaction between the colorant and the resin, an organic solvent can be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is preferable because the wet cake of the colorant can be used as it is without drying. When performing the mixing or kneading, a high shearing force dispersing device such as a three roll mill can be preferably used.

External Additive

The toner includes one or more external additives, and at least one of the external additives includes primary particles having a number average particle diameter in the range of 0.05 to 0.30 μm. A large-particle-diameter external additive acts as a spacer that prevents the toner from contacting other members. A small-particle-diameter external additive gives flowability to the toner. The larger the particle diameter of the external additive becomes, the more likely the external additive releases from the toner and transfers to the photoconductor. The external additive is for giving flowability and/or chargeability to the toner. The external additive may include both fine inorganic particles and fine organic particles.

Preferably, at least one of the external additives has a charging polarity opposite to the polarity of the mother particle. By including an external additive having a polarity opposite to that of the mother particle, the toner is suppressed from adhering to the cleaning blade when developed in a non-image area.

Fine Inorganic Particle

Specific materials usable as the fine inorganic particle include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium dioxide arc preferable. In view of adhesive property to other members, silica is preferable, and a hydrophobized silica is more preferable. The hydrophobized silica itself is likely not to adhere to a cleaning member, suppressing image degradation.

Fine Organic Particle

Specific materials usable as the fine organic particle include, but are not limited to, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

Hydrophobizing Treatment

Preferably, the external additive has a hydrophobized surface. One example of hydrophobizing treatment involves chemically treating a fine inorganic particle with an organic silicon compound which is reactive with or physically adsorptive to the fine inorganic particle. One preferred method involves producing a fine inorganic particle by vapor phase oxidization of a metal halide, and treating the fine inorganic particle with an organic silicon compound.

Specific examples of the organic silicon compound include, but are not limited to, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyl dimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule with the terminal units having a hydroxyl group bound to one Si.

The fine inorganic particle can also be hydrophobized with a nitrogen-containing silane coupling agent. In a case where the mother particle has a negative charging polarity and an external additive having a polarity opposite to that of the mother particles is to be used, a fine particle having a surface treated with a nitrogen-containing silane coupling agent is preferably used as the external additive. Specific examples of the nitrogen-containing silane coupling agent include, but are not limited to, aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, trimethoxysilyl-γ-propylbenzylamine, trimethoxysilyl-γ-propylpiperidine, trimethoxysilyl-γ-propylmorpholine, and trimethoxysilyl-γ-propylimidazole. These agents can be used alone or in combination.

In addition, a fine inorganic particle, having been either hydrophobized or not, treated with a silicone oil can also be used. Specific examples of the silicone oil include, but are not limited to, dimethyl silicone oil, methyl phenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic-modified silicone oil, methacrylic-modified silicone oil, and α-methylstyrene-modified silicone oil. These silicone oils can be used alone or in combination. One example of silicone oil treatments involves bringing a fine inorganic particle having been dehydrated and dried in an oven at several hundred degrees C. into uniform contact with a silicone oil to adhere the silicone oil to the surface of the fine inorganic particle. To adhere the silicone oil to the surface of the fine inorganic particle, the fine inorganic particle in a powdery state is mixed with the silicone oil by a mixer having rotating blades, or dipped in a silicone oil diluted with a solvent having a relatively low boiling point, followed by drying the solvent. When the silicone oil has high viscosity, the treatment is preferably performed in a liquid. The powdery fine inorganic particle having the adhered silicone oil is then heated in an oven at 100 to several hundred degrees C. (normally about 400 degrees C.) so that the metal and the silicone oil form siloxane bonds with the hydroxyl groups on the surface of the fine inorganic particles and the silicone oil itself becomes more polymerized or cross-linked. It is possible that a catalyst, such as an acid, an alkali, a metal salt, zinc octylate, tin octylate, and dibutyltin dilaurate, is previously included in the silicone oil for accelerating the reaction. As the silicone oil transfers to the latent image bearer, the frictional force with the cleaning blade is reduced for an extended period of time. As a result, abrasion of the latent image bearer is drastically suppressed.

The fine inorganic particle may be treated with a silane coupling hydrophobizing agent prior to the silicone oil treatment. In this case, the adsorption amount of silicone oil is increased.

Quantitative Determination of External Additives

Quantitative determination of the external additives in the toner is performed as follows. First, a toner in an amount of 2 g is pelletized into a circular pellet by applying a force of 1 $N/cm^2$ (10 MPa) for 60 seconds by a pressing machine. The pellet is subjected to quantitative determination of characteristic elements (e.g., Si, Ti) in the external additives by a wavelength-dispersive X-ray fluorescence spectrometer XRF1700 from Shimadzu Corporation, to compile calibration curves. The composition amounts (% by weight) of the external additives (e.g., the amounts of fine metal oxide particles such as $SiO_2$ and $TiO_2$) in the toner are calculated by calibration curve method.

Average Particle Diameter of Primary Particles of External Additive

At least one of the external additives includes primary particles having a number average particle diameter in the range of 0.05 to 0.30 μm.

An external additive including primary particles having a number average particle diameter less than 0.05 μm is likely to be embedded in the mother particle without transferring onto the photoconductor for an extended period of time. As a result, formation of a rigid accumulation layer becomes unreliable.

An external additive including primary particles having a number average particle diameter in excess of 0.30 μm, the toner flowability becomes too low to function as toner. Moreover, such an external additive is likely to release from the mother particle and unevenly damage the surface of the photoconductor.

Addition Amount of External Additive

The addition amount of the external additive including primary particles having a number average particle diameter in the range of 0.05 to 0.30 μm is preferably from 0.5 to 5.0 parts by weight based on 100 parts by weight of the mother particle. In this case, the external additive is suppressed from adhering to the cleaning blade.

The total amount of the external additives is preferably from 1.0 to 7.0 parts by weight based on 100 parts by weight of the mother particle. When the total amount is less than 1.0 part by weight, formation of a rigid accumulation layer becomes unreliable. When the total amount is in excess of 7.0 parts by weight, an excessive amount of the external additives becomes free, causing contamination to members and deterioration in low-temperature fixability. When two or more external additives are used in combination, the total amount of all the external additives is preferably within the specified range.

Two or more external additives can be used in combination. In view of toner flowability, those having a small particle diameter are preferably used. A small-particle-diameter external additive preferably includes primary particles having a number average particle diameter in the range of 0.01 to 0.05 μm, more preferably 0.01 to 0.02 μm. When the number average particle diameter of primary particles is less than 0.01 μm, such an external additive may be significantly embedded in the mother particle and a desired level of flowability may not be obtained. When the number average particle diameter of primary particles is in excess of 0.02 μm, a desired level of flowability may not be obtained.

Average particle diameter of the external additive can be measured by particle size distribution measuring instruments, such as DLS-700 from Otsuka Electronics Co., Ltd. and COULTER N4 from Coulter Electronics, Inc. Because it is difficult to dissociate aggregated particles, average particle diameter is preferably directly determined from toner images obtained with a scanning electron microscope or transmission electron microscope. In this case, at least 100 particles of the external additive are observed and their long diameters are averaged. When particles of the external additive get aggregated at the surface of the toner, the long diameter of each primary particle composing the aggregation is measured.

Treatment Method

The external additive is added to the toner by mixing. The mixing is performed by a powder mixer preferably equipped with a jacket for controlling the inner temperature. The history of load applied to the external additive can be changed by, for example, adding the external additive in the process of mixing at once or as needed. Of course, it is also possible to change rotation number, rolling speed, time, and temperature. A high load may be applied first and a relatively low load thereafter, or vice versa. Specific examples of the mixer include, but are not limited to, locking mixer, Loedige Mixer, NAUTA MIXER, and HENSCHEL MIXER.

Release Agent

The toner may include a release agent for improving separability in the toner fixing process. The release agent can be included in the toner by, for example, being dispersed in an organic solvent in which toner materials are dispersed in the process of manufacturing the toner.

Materials which exert a very low viscosity and become poorly compatible with or swellable other materials and the surface of a fixing member when heated in the fixing process, such as wax and silicone oil, are used as the release agent. Wax is more preferable because of its storage stability, i.e., it exists as a solid when stored in normal conditions.

Specific examples of the wax include, but are not limited to, long-chain hydrocarbons and carbonyl-group-containing waxes. Specific examples of the long-chain hydrocarbons include, but are not limited to, polyolefin waxes (e.g., polyethylene wax, polypropylene wax), petroleum waxes (e.g., paraffin wax, SASOL wax, microcrystalline ax), and Fischer-Tropsch wax.

Specific examples of the carbonyl-group-containing waxes include, but are not limited to, polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanol esters (e.g., tristearyl trimellitate, distearyl maleate), polyalkanoic acid amides (e.g., ethylenediamine dibehenylamide), polyalkyl amides (e.g., trimellitic acid tristearylamide), and dialkyl ketones (e.g., distearyl ketone).

Among these waxes, long-chain hydrocarbons are preferable because of their excellent releasability. When a long-chain hydrocarbon is used as the release agent, a carbonyl-group-containing wax can be used in combination. The release agent preferably accounts for 2% to 25% by weight, more preferably 3% to 20% by weight, and most preferably 4% to 15% by weight, of the toner. When it accounts for less than 2% by weight, the separability may not be improved. When it accounts for greater than 25% by weight, the toner mechanical strength may deteriorate.

Charge Controlling Agent

A charge controlling agent may be dissolved or dispersed in the organic solvent, if needed. Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901 and LR-147 (boron complex), which are manufactured by Japan Carlit Co., Ltd.; and copper phthalocyanine, perylene, quinacridone, azo pigments, and polymers having a functional group such as a sulfonate group, a carboxyl group, and a quaternary ammonium group. The amount of the charge controlling agent is determined so that the charge controlling agent exerts its function without inhibiting fixing property. The charge controlling agent preferably accounts for 0.5% to 5% by weight, preferably 0.8% to 3% by weight, of the toner.

Method of Manufacturing Toner

The toner can be manufactured by any known wet granulation method, such as dissolution suspension method, suspension polymerization method, and emulsion aggregation method, or pulverization method. In view of ease in controlling particle size and shape, dissolution suspension method and emulsion aggregation method are preferable.

In the case where emulsion aggregation method or suspension polymerization method is employed, the mother particle is prepared by the method first and fine resin particles are thereafter added to the reaction system, thereby adhering or fusing the fine resin particles to the surface of the mother particle. To accelerate the adhering or fusing, the reaction system may be heated. Alternatively, adding a metal salt to the reaction system may also be effective for accelerating the adhering or fusing.

Fine Resin Particles

The fine resin particles for forming projections may be in the form of an aqueous dispersion. Specific examples of the resin composing the fine resin particles include, but are not limited to, vinyl resin, polyester, polyurethane, polyurea, and epoxy resin. Among these resins, vinyl resin is preferable because an aqueous dispersion of fine particles thereof is easily obtainable. An aqueous dispersion of fine particles of a vinyl resin (hereinafter "fine vinyl resin particles") is obtainable by any known polymerization method such as emulsion aggregation method, suspension polymerization method, and dispersion polymerization method. In accordance with some embodiments of the present invention, emulsion polymerization method is most preferable because a particle of a suitable size is easily obtainable.

Fine Vinyl Resin Particles

The fine vinyl resin particles include a vinyl resin obtained by polymerizing mixed monomers including at least a styrene-based monomer.

The mother particle of the toner preferably has an easily-chargeable surface. To achieve this, the mixed monomers preferably include a styrene-based monomer having an electron orbit on which electrons can stably exist, such as an aromatic ring structure, in an amount of 50% to 100% by weight, preferably 80% to 100% by weight, and more preferably 95% to 100% by weight, based on total weight of the mixed monomers. When the amount of the styrene-based monomer is less than 50% by weight, the resulting toner may be poor in chargeability and limited in application.

Here, the styrene-based monomer refers to an aromatic compound having a vinyl polymerizable functional group. Specific examples of the vinyl polymerizable functional group include, but are not limited to, vinyl group, isopropenyl group, allyl group, acryloyl group, and methacryloyl group.

Specific examples of the styrene-based monomer include, but are not limited to, styrene, α-methylstyrene, 4-methylstyrene, 4-ethylstyrene, 4-tert-butylstyrene, 4-methoxystyrene, 4-ethoxystyrene, 4-carboxystyrene and metal salts thereof, 4-styrenesulfonic acid and metal salts thereof, 1-vinylnaphthalene, 2-vinylnaphthalene, allylbenzene, phenoxyalkylene glycol acrylate, phenoxyalkylene glycol methacrylate, phenoxypolyalkylene glycol acrylate, and phenoxypolyalkylene glycol methacrylate. Among these monomers, styrene is preferable because it is easily available and has high reactivity and chargeability.

The mixed monomers for preparing the vinyl resin preferably include an acid monomer in an amount of 0% to 7% by weight, more preferably 0% to 4% by weight, based on total weight of the mixed monomers. Most preferably, the mixed monomers include no acid monomer. When the amount of the acid monomer is in excess of 7% by weight, the resulting fine vinyl resin particles have high dispersion stability. Such line vinyl resin particles having high dispersion stability are not likely to adhere to oil droplets dispersed in an aqueous phase at normal temperatures, or, even when once adhered to the oil droplets, they are likely to release from the oil droplets through the processes of solvent removal, washing, drying, and external treatment. When the amount of the acid monomer is less than 4% by weight, the resulting toner becomes less environmentally-variable in chargeability.

Here, the acid monomer refers to a compound having a vinyl polymerizable functional group and an acid group. Specific examples of the acid group include, but are not limited to, carboxyl group, sulfonyl group, and phosphoryl group.

Specific examples of the acid monomer include, but are not limited to, carboxyl-group-containing vinyl monomers and salts thereof (e.g., acrylic acid, methacrylic acid, maleic acid, maleic acid anhydride, monoalkyl maleate, fumaric acid, monoalkyl fumarate, crotonic acid, itaconic acid, monoalkyl itaconate, itaconic acid glycol monoether, citraconic acid, monoalkyl citraconate, cinnamic acid), sulfonic-acid-group-containing vinyl monomers, vinyl sulfuric acid monoester and salts thereof, and phosphoric-acid-group-containing vinyl monomers and salts thereof. Among these monomers, acrylic acid, methacrylic acid, maleic acid, maleic acid anhydride, monoalkyl maleate, fumaric acid, and monoalkyl fumarate are preferable.

To control compatibility with core particles, the mixed monomers may include a monomer having an ethylene oxide (EO) chain, such as phenoxyalkylene glycol acrylate, phenoxyalkylene glycol methacrylate, phenoxypolyalkylene glycol acrylate, and phenoxypolyalkylene glycol methacrylate, in an amount of 10% by weight or less, preferably 5% by weight or less, more preferably 2% by weight or less, based on total weight of the mixed monomers. When the amount exceeds 10% by weight, the amount of polar group at the surface of the toner increases to significantly decrease environmental stability of the toner. In addition, compatibility with core particles becomes so high that the coverage of the projections becomes small. As a result, surface modification effect is not likely to be obtained. In addition, to control compatibility with core particles, a monomer having an ester bond, such as 2-acryloyloxyethyl succinate and 2-methacryloyloxyethyl phthalic acid, can also be used. The amount of the monomer having an ester bond is 10% by weight or less, preferably 5% by weight or less, more preferably 2% by weight or less, based on total weight of the mixed monomers. When the amount exceeds 10% by weight, the amount of polar group at the surface of the toner increases to significantly decrease environmental stability of the toner. In addition, compatibility with core particles becomes so high that the coverage of the projections becomes small. As a result, surface modification effect is not likely to be obtained.

The fine vinyl resin particles can be obtained by one of the following methods (a) to (f).

(a) Subjecting a monomer mixture to a polymerization reaction, such as suspension polymerization, emulsion polymerization, and seed polymerization, thus obtaining a dispersion liquid of fine vinyl resin particles.

(b) Subjecting a monomer mixture to a polymerization, pulverizing the resulting resin by a mechanically-rotary or jet-propelled pulverizer, and classifying the pulverized particles.

(c) Subjecting a monomer mixture to a polymerization, preparing a resin solution by dissolving the resulting resin in a solvent, and spraying the resin solution.

(d) Subjecting a monomer mixture to a polymerization; preparing a resin solution by dissolving the resulting resin in a solvent and adding a solvent in the resin solution, or preparing a resin solution by dissolving the resulting resin in a solvent by heat and cooling the resin solution, to precipitate fine resin particles; and removing the solvent.

(e) Subjecting a monomer mixture to a polymerization, preparing a resin solution by dissolving the resulting resin in a solvent, dispersing the resin solution in an aqueous medium in the presence of a dispersant, and removing the solvent by application of heat or reduction of pressure.

(f) Subjecting a monomer mixture to a polymerization, preparing a resin solution by dissolving the resulting resin in a solvent, dissolving an emulsifier in the resin solution, and adding water in the resin solution to cause phase-transfer emulsification.

Among these methods, the method (a) is preferable because it is easy and simple and is capable of providing fine resin particles in the form of dispersion liquid, which can be smoothly used in the next process.

In the method (a), it is preferable that an aqueous medium in which the polymerization reaction is caused contains a dispersion stabilizer, and/or that polymerizable monomers include a monomer capable of giving dispersion stability to the resulting fine resin particles (i.e., reactive emulsifier), to give dispersion stability to the resulting fine vinyl resin particles. If no dispersion stabilizer and/or reactive emulsifier is used, it may not be possible to disperse the vinyl resin into fine particles at all; the resulting fine resin particles may aggregate during storage because of their poor storage stability because of their poor dispersion stability; or core particles may aggregate or coalesce in the process of adhering the fine resin particles to the core particles (to be described in detail later) because of poor dispersion stability of the fine resin particles. The resulting mother particle will therefore lack uniformity in particle diameter, shape, and surface profile.

The dispersion stabilizer includes surfactant and inorganic dispersant. Specific examples of the surfactant include, but are not limited to, anionic surfactants such as alkylbenzene sulfonate, α-olefin sulfonate, and phosphates; cationic surfactants such as amine salt surfactants (e.g., alkylamine salts, amino alcohol fatty acid derivatives, polyamine fatty acid derivatives, imidazoline) and quaternary ammonium salt surfactants (e.g., alkyl trimethyl ammonium salts, dialkyl dimethyl ammonium salts, alkyl dimethyl benzyl ammonium salts, pyridinium salts, alkyl isoquinolinium salts, benzethonium chloride); nonionic surfactants such as fatty acid amide derivatives and polyol derivatives; and ampholytic surfactants such as alanine, dodecyldi(aminoethyl)glycine, di(octylaminoethyl)glycine, and N-alkyl-N,N-dimethyl ammonium betaine. Specific examples of the inorganic dispersant include, but are not limited to, tricalcium phosphate, calcium carbonate, titanium oxide, colloidal silica, and hydroxyapatite.

The vinyl resin preferably has a weight average molecular weight in the range of 3,000 to 300,000, more preferably 4,000 to 100,000, and most preferably 5,000 to 50,000. When the weight average molecular weight is less than 3,000, the vinyl resin has low mechanical strength and is brittle. Depending on usage conditions, the surface of the resulting mother particle may easily alter to cause drastic variation in chargeability, contamination of peripheral members, and quality issue accompanied thereby. When the weight average molecular weight in excess of 300,000, the number of molecular terminals is reduced and the degree of entanglement between core particles and molecular chains is reduced, resulting in deterioration of adhesiveness to core particles.

The vinyl resin preferably has a glass transition temperature (Tg) in the range of 45° C. to 100° C., preferably 55° C. to 90° C., and more preferably 65° C. to 80° C. When the toner is stored in a high-temperature and high humidity environment, there is a possibility that the resin forming projections is plasticized by moisture in the air to cause glass transition temperature decrease. During transportation, it is assumed that toner or toner cartridge is exposed to a high-temperature and high-humidity environment at 40° C. and 90%. There is a possibility that the mother particle is deformed under a certain pressure or the mother particles stick together without behaving as a particle. Therefore, the glass transition temperature of less than 45° C. is not preferable. When the toner is used for one-component development, the glass transition temperature of less than 45° C. is also not preferable because friction resistance may deteriorate. When the glass transition temperature is in excess of 100° C., fixability may deteriorate.

Process of Preparing Oily Phase

An oily phase, in which a resin, a colorant, etc., are dissolved or dispersed in an organic solvent, can be prepared by gradually adding the resin, colorant, etc., in the organic solvent while stirring the organic solvent. When a pigment is used as the colorant, and/or a charge controlling agent or release agent which is poorly soluble in the organic solvent is used, it is preferable that such materials be previously ground into fine particles before being added to the organic solvent.

One possible method includes the use of colorant master batch as described above. Similarly, release agents and charge controlling agents may be previously combined with a resin to be formed into a master batch.

Alternatively, colorants, release agents, and charge controlling agents, optionally along with a dispersing auxiliary agent, may be previously combined with a resin in a wet condition (i.e., in an organic solvent) to be formed into a wet master batch.

When such materials are meltable at temperatures below the boiling point of the organic solvent, they can be previously crystallized. In other words, they can be formed into fine crystal grain by being dissolved in the organic solvent, optionally along with a dispersing auxiliary agent, while stirring and heating the organic solvent and subsequently being cooled while stirring or shearing the organic solvent.

After being dispersed in the organic solvent along with the resin by the above procedures, the colorants, release agents, and charge controlling agents may be further subjected to a dispersion treatment using a disperser, such as a bead mill and a disc mill.

Process of Preparing Mother Particle

A dispersion liquid in which mother particles composed of the oily phase are dispersed in the aqueous medium can be prepared by dispersing the above-prepared oily phase in the aqueous medium containing a surfactant using an equipment of any of the following types: low-speed shearing type, high-speed shearing type, frictional type, high-pressure jet type, and ultrasonic type. To adjust the particle diameter of the dispersing elements to 2 to 20 μm, a high-speed shearing type disperser is preferable. When a high-speed shearing type disperser is used, the revolution is set to typically from 1,000 to 30,000 rpm and preferably from 5,000 to 20,000 rpm. The dispersing time for a batch type disperser is typically from 0.1 to 5 minutes, but is not limited thereto. When the dispersing time exceeds 5 minutes, undesired small-diameter particles may remain or the dispersion may become excessively dispersed or unstable to generate aggregations and coarse particles. The dispersing temperature is typically from 0° C. to 40° C. and preferably from 10° C. to 30° C. When the dispersing temperature exceeds 40° C., molecular motion becomes active to reduce dispersion stability and to generate aggregations and coarse particles. When the dispersing temperature falls below 0° C., the dispersing elements increase in viscosity to increase the shearing force needed for dispersing them, resulting in decrease in manufacturing efficiency. The above-described examples of surfactants to be used for preparing the fine resin particles can also be used for this process. In order to efficiently disperse oil droplets containing solvents, disulfonic acid salts having a high HLB are preferably used. The content of the surfactant in the aqueous medium is from 1% to 10% by weight, preferably from 2% to 8% by weight, and more preferably from 3% to 7% by weight. When the content exceeds 10% by weight, the oil droplets may become too small or form a reverse micelle structure to reduce dispersion stability and to coarsen the oil droplets. When the content falls below 1% by weight, it is difficult to stably disperse the oil droplets and the oil droplets get coarsened.

Process of Adhering Fine Resin Particles

When dissolution suspension method is employed, although the above-described processes may be applied, the following procedure is more preferable. Namely, an oily phase, in which constituent materials for core particle is dissolved or dispersed in an organic solvent, is dispersed in an aqueous medium first, and then fine resin particles are added thereto to make them adhere or fuse to the surfaces of the oil phase droplets. By this procedure, the fine resin particles strongly adhere or fuse to the core particle. If fine resin particles are added in the process of producing the core particle, the resulting projections may become coarse and non-uniform, which is not preferable.

In the resulting core particle dispersion liquid, liquid droplets of the core particles can be stably dispersed while the core particle dispersion liquid is being stirred. By pouring the dispersion liquid of fine vinyl resin particles in the core particle dispersion liquid being stirred, the fine vinyl resin particles are adhered to the surfaces of the core particles. It is preferable that the amount of time it takes to pour the dispersion liquid of fine vinyl resin particles in the core particle dispersion liquid is 30 seconds or more. When the amount of time is less than 30 seconds, the dispersion system is rapidly changed to generate aggregated particles or the adherence of the fine vinyl resin particles becomes non-uniform. Taking too large an amount of time, for example, more than 60 minutes, is not preferable in terms of production efficiency.

The dispersion liquid of fine vinyl resin particles may be diluted or condensed to adjust the concentration before being poured in the core particle dispersion liquid. The dispersion liquid of fine vinyl resin particles preferably has a concentration in the range of 5% to 30% by weight, more preferably 8% to 20% by weight. When the concentration falls below 5% by weight, a large change in organic solvent concentration is caused upon pouring of the dispersion liquid, resulting in insufficient adherence of the fine resin particles to the core particles. When the concentration exceeds 30% by weight, it is likely that the fine vinyl resin particles are non-uniformly distributed in the core particle dispersion liquid, resulting in non-uniform adherence of the fine vinyl resin particles to the core particles.

In preparing droplets of the oily phase, the surfactant accounts for 7% by weight or less, preferably 6% by weight or less, and more preferably 5% by weight or less, of the aqueous phase. When the surfactant accounts for greater than 7% by weight of the aqueous phase, the long side length of the projection may become significantly non-uniform, which is not preferable.

A reason why the fine vinyl resin particles are adhered to the core particles with a sufficient strength by the above-described processes is considered that: 1) the fine vinyl resin particles sufficiently form contact surfaces with the core particles upon contact therewith because liquid droplets of the core particles are deformable; and that 2) the fine vinyl resin particles become swelled or dissolved in the organic solvent to be easily adhesive to the resin contained in the core particles. Accordingly, it is necessary that a sufficient amount of the organic solvent exists in the system. In particular, the content of the organic solvent is preferably from 50% to 150% by weight, more preferably from 70% to 125% by weight, based on solid contents (i.e., resin, colorant, release agent, charge controlling agent, etc.) in the dispersion liquid of the core particles. When the content exceeds 150% by weight, the yield of the mother particles decreases to reduce production efficiency. In addition, dispersion stability also reduces to suppress reliable production.

The temperature at adhering the fine vinyl resin particles to the core particles is from 10° C. to 60° C., preferably from 20° C. to 45° C. When the temperature is in excess of 60° C., more energy is required in the production process to increase production environment load. Moreover, because the fine vinyl resin particles existing at the surfaces of the liquid droplets have a low acid value, there is a possibility that the dispersion is destabilized and coarse particles are generated. When the temperature is less than 10° C., the viscosity of the dispersing elements becomes too high, resulting in insufficient adherence of the fine resin particles to the mother particles.

The fine resin particles account for 1% to 20% by weight, preferably 3% to 15% by weight, and more preferably 5% to 10% by weight, of the toner. When the fine resin particles account for 1% by weight or less of the toner, the effect thereof may be insufficient. When the fine resin particles account for greater than 20% by weight, excessive fine resin particles may weakly adhere to the mother particles and the resulting toner may cause filming. It is also possible to mechanically mix the mother particles with the fine resin particles to adhere the fine resin particles to the mother particles or cover the mother particles with the fine resin particles.

Process of Removing Solvent

To remove the organic solvent from the resulting mother particle dispersion, it is possible that the dispersion is gradually heated while being stirred so that the organic solvent is completely evaporated from the liquid droplets.

Alternatively, it is also possible that the mother particle dispersion is sprayed into dry atmosphere so that the organic solvent is completely removed from the liquid droplets. Alternatively, it is also possible that the mother particle dispersion is stirred under reduced pressures so that the organic solvent is evaporated. The latter two methods can be combined with the first method.

The dry atmosphere into which the dispersion is sprayed may be, for example, heated gaseous matter of air, nitrogen, carbon dioxide gas, or combustion gas, and especially those heated to above the maximum boiling point among the used solvents. Such a treatment can be reliably performed by a spray drier, a belt drier, or a rotary kiln, within a short period of time.

Aging Process

In a case where a modified resin having a terminal isocyanate group is used, an aging process may be introduced for accelerating elongation and/or cross-linking reaction of the isocyanate. The aging time is typically from 10 minutes to 40 hours, and preferably 2 to 24 hours. The reaction temperature is typically from 0° C. to 65° C., and preferably from 35° C. to 50° C.

Washing Process

The dispersion liquid of the mother particles prepared in the above-described manner contains sub materials such as dispersants (e.g., surfactants) other than the mother particles. The mother particles are isolated from the dispersion liquid by washing. The washing of the mother particles can be performed by means of centrifugal separation, reduced pressure filtration, filter press, or the like. In either method, a cake of the mother particles is obtained. If washing is insufficient in one operation, it is possible to redisperse the cake in an aqueous medium to prepare a slurry and repeat the above method. In the case where the washing is performed by reduced pressure filtration or filter press, it is possible to let an aqueous medium pass through the cake to wash the sub materials away from the mother particles. As the aqueous medium for use in the washing process, water or a mixed solvent of water with an alcohol (e.g., methanol, ethanol) is used. In view of cost and environmental load caused by effluent treatment, water is preferable.

Drying Process

After the washing process, the mother particles contain the aqueous medium in large amount. The mother particles are isolated by removing the aqueous medium therefrom by drying. The drying can be performed by means of spray dryer, vacuum freeze dryer, reduced pressure dryer, standstill shelf dryer, movable shelf dryer, fluidized bed dryer, rotary dryer, stirring dryer, or the like. It is preferable that the mother particles are subjected to the drying until residual moisture becomes 1% or less. In a case where the dried mother particles are in the form of soft aggregate to cause an inconvenience, the soft aggregate may be loosen by means of jet mill, HENSCHEL MIXER, SUPER MIXER, coffee mill, OSTER BLENDER, food processor, or the like.

Particle Diameter of Toner

The toner preferably has a volume average particle diameter in the range of 3 to 9 μm, more preferably 4 to 8 μm, and most preferably 4 to 7 μm, to be uniformly and sufficiently charged. When the volume average particle diameter is less than 3 μm, toner adhesive force may relatively increase to reduce toner operability by electric fields, which is not preferable. When the volume average particle diameter is in excess of 9 μm, image quality such as thin line reproducibility may deteriorate.

The ratio of the volume average particle diameter to the number average particle diameter is preferably 1.25 or less, more preferably 1.20 or less, and most preferably 1.17 or less. When the ratio is in excess of 1.25, the toner is poor in particle size uniformity and therefore the projections may become non-uniform in size. As the development is repeated, toner particles having a large size, or a small size in some cases, are consumed, and the average particle diameter of the toner is changed to change the conditions for developing residual toner particles. As a result, various undesirable phenomena are likely to occur, such as defective charging, extreme increment or decrement in feed quantity, toner clogging, and toner spilling.

Particle size distribution of toner particles is measured by a particle size analyzer such as COULTER COUNTER TA-II and COULTER MULTISIZER II (both available from Beckman Coulter Inc.), in the following manner.

First, 0.1 to 5 ml of a surfactant (preferably an alkylbenzene sulfonate), serving as a dispersant, is added to 100 to 150 ml of an electrolyte. Here, the electrolyte is an about 1% NaCl aqueous solution prepared with the first grade sodium chloride, such as ISOTON-II (available from Beckman Coulter, Inc.). A sample in an amount of from 2 to 20 mg is then added thereto. The electrolyte in which the sample is suspended is subjected to a dispersion treatment using an ultrasonic disperser for about 1 to 3 minutes and then to the measurement of the volume and number of toner particles using the above-described instrument equipped with a 100-μm aperture to calculate volume and number distributions. The volume average particle diameter (D4) and number average particle diameter (D1) of the sample can be calculated from the volume and number distributions obtained above.

Thirteen channels with the following ranges are used for the measurement: 2.00 or more and less than 2.52 μm; 2.52 or more and less than 3.17 μm; 3.17 or more and less than 4.00 μm; 4.00 or more and less than 5.04 μm; 5.04 or more and less than 6.35 μm; 6.35 or more and less than 8.00 μm; 8.00 or more and less than 10.08 μm; 10.08 or more and less than 12.70 μm; 12.70 or more and less than 16.00 μm; 16.00 or more and less than 20.20 μm; 20.20 or more and less than 25.40 μm; 25.40 or more and less than 32.00 μm; and 32.00 or more and less than 40.30 μm. Namely, particles having a particle diameter of 2.00 or more and less than 40.30 μm are to be measured.

Shape of Toner

The toner has an average circularity of 0.930 or more, preferably 0.950 or more, and more preferably 0.970 or more. When the average circularity is less than 0.930, the external additive may be accumulated on concave portions and the toner may become difficult to be supplied with silicone oil. Moreover, the toner flowability may decrease to cause defective development and deterioration in transfer efficiency.

The average circularity is measured by a flow particle image analyzer FPIA-2000. Specifically, 0.1 to 0.5 ml of a surfactant (preferably an alkylbenzene sulfonate), serving as a dispersant, is added to 100 to 150 ml of water from which solid impurities have been removed, and further 0.1 to 0.5 g of a sample is added thereto. The resulting suspension liquid in which the sample is suspended is subjected to a dispersion treatment using an ultrasonic disperser for about 1 to 3 minutes and then to the measurement of the shapes of toner particles and its distribution using the above-described instrument while adjusting the dispersion liquid concentration to from 3,000 to 10,000 particles/μl.

In the case where the toner is produced by a wet granulation method, ionic materials are unevenly distributed in the vicinity of the toner surface and the toner surface becomes relatively low in resistance. As a result, toner charging speed becomes large to improve charge rising property, but charge retaining property is poor and toner charge amount is likely to attenuate rapidly. Such a problem can be solved by, for example, making the toner bear a surface modifying material.

Measurement of Particle Diameter of Fine Vinyl Resin Particles

Particle diameters of the fine resin particles are measured by UPA-150EX (available from Nikkiso Co., Ltd.).

The fine resin particles have a particle diameter in the range of 50 to 200 nm, preferably 80 to 160 nm, and more preferably 100 to 140 nm. When the particle diameter is less than 50 nm, it may be difficult to form projections with a sufficient size on the surface of the toner. When the particle diameter is in excess of 200 nm, the projections may become non-uniform. The ratio of the volume average particle diameter to the number average particle diameter is preferably 1.25 or less, more preferably 1.20 or less, and most preferably 1.17 or less. When the ratio is in excess of 1.25, the fine resin particles are poor in particle size uniformity and therefore the projections may become non-uniform in size.

Measurement of Molecular Weight (GPC)

Molecular weights of resins are measured by GPC (gel permeation chromatography) under the following conditions.

Instrument: GPC-150C (from Waters)

Column: KF801-807 (from SHODEX)

Temperature: 40° C.

Solvent: THF (tetrahydrofuran)

Flow rate: 1.0 mL/min

Sample concentration: 0.05%-0.6%, Injection amount: 0.1 mL

The number average molecular weight and weight average molecular weight are determined from the resulting molecular weight distribution curve with reference to a calibration curve complied with monodisperse polystyrene standard samples. The monodisperse polystyrene standard samples include Shodex STANDARD Std. No. S-7300, S-210, S-390, S-875, S-1980, S-10.9, S-629, S-3.0, and S-0.580 (available from Showa Denko K.K.) and toluene. As the detector, an RI (refractive index) detector is used.

Measurement of Glass Transition Temperature (Tg) (DSC)

An instrument TG-DSC system TAS-100 (from Rigaku Corporation) is used for measuring Tg.

First, about 10 mg of a sample is put in an aluminum sample container. The container is put on a holder unit and set in an electric furnace. During a DSC measurement, the sample is heated from room temperature to 150° C. at a temperature rising rate of 10° C./min, left at 150° C. for 10 minutes, cooled to room temperature and left for 10 minutes, and reheated to 150° C. at a temperature rising rate of 10° C./min in nitrogen atmosphere. Tg is calculated by an analysis system of TAS-100 by determining the contact point of a tangent line of the endothermic curve near Tg and the baseline.

Measurement of Solid Content Concentration

Solid content concentration in the oily phase is determined as follows.

On an aluminum dish (having a weight of about 1 to 3 g), the mass of which has been precisely weighed, 2 g of an oily phase is put within 30 seconds, and the mass of the oily phase is precisely weighed. The aluminum dish is put in an oven at 150° C. for 1 hour to evaporate the solvent, taken out from the oven and left as it is to be cooled, and then subjected to a measurement of total mass of the aluminum dish and solid contents in the oily phase with an electronic balance. The mass of solid contents in the oily phase is calculated by subtracting the mass of the aluminum dish from the total mass of the aluminum dish and solid contents in the oily phase. The solid content concentration in the oily phase is calculated by dividing the mass of solid contents in the oily phase with the mass of the oily phase. The ratio of the solvent to the solid contents in the oily phase is calculated by dividing the value obtained by subtracting the mass of solid contents in the oily phase from that of the oily phase (i.e., the mass of the solvent) with the mass of solid contents in the oily phase.

Measurement of Acid Value

Acid value of a resin is measured according to JIS K1557-1970. A detailed measuring method is as follows.

First, about 2 g of a sample, having been pulverized, is precisely weighed (W (g)). A 200-ml conical flask is charged with the sample and 100 ml of a mixed solvent of toluene and ethanol (at a mixing ratio of 2:1), and the sample is dissolved in the mixed solvent over a period of 5 hours. A phenolphthalein solution is further added to the flask as an indicator.

The resulting solution is titrated with 0.1N alcohol solution of potassium hydroxide (KOH) using a burette. The amount of the KOH solution used in the titration is identified as S (ml). The amount of the KOH solution used in a blank test is identified as B (ml).

Acid value is calculated from the following formula.

$$\text{Acid Value}=[(S-B)\times f\times 5.61]/W$$

wherein f represent the factor of the KOH solution.

Long Side and Coverage of Projections

Figure 6:
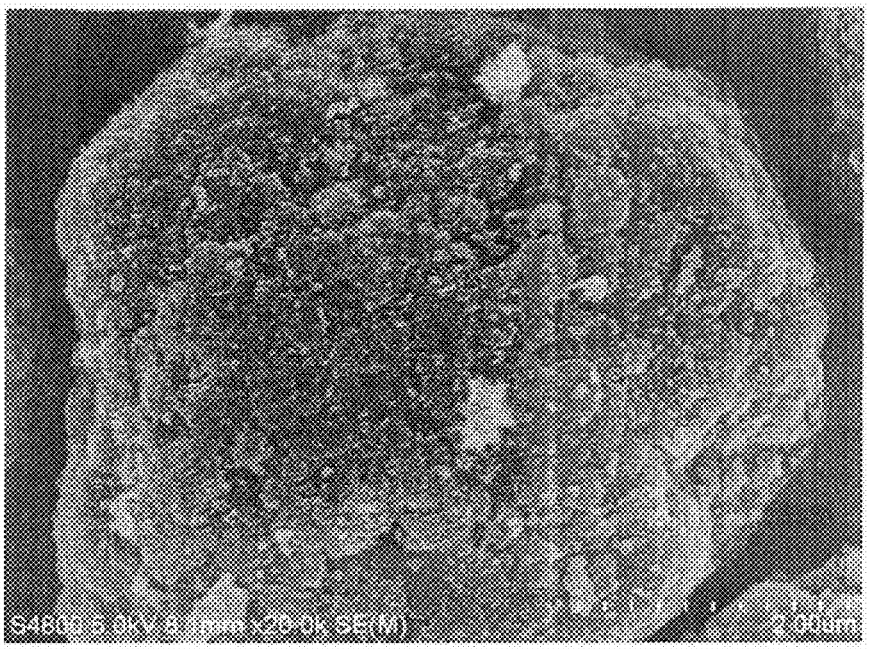
FIG. 6 is a SEM (scanning electron microscope) image of a toner according to an embodiment of the present invention.
Figure 7:
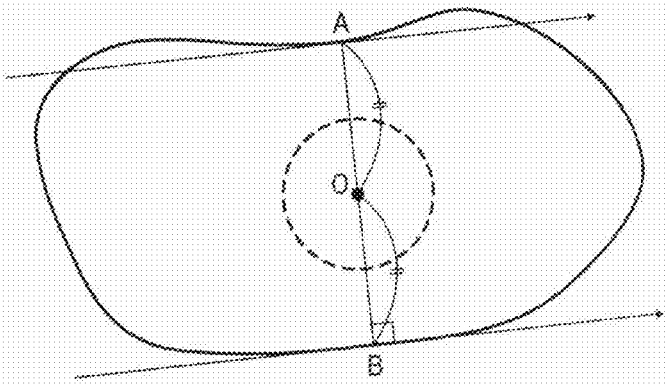
FIG. 7 is a chart for explaining how to calculate the coverage of projections on a toner particle.

The length of the long side and the coverage of the projections on the toner are determined from an image obtained by a scanning electron microscope (SEM). FIG. 6 is a SEM image of a toner according to an embodiment of the present invention. FIG. 7 is a chart for explaining how to calculate the coverage of projections on a toner particle.

Methods of calculating the length of the long side and the coverage of the projections on the toner employed in EXAMPLES are described below.

The coverage is determined as follows. First, the minimum distance between two parallel lines each contacting a toner particle is determined, and the contact points are identified as A and B, as illustrated in FIG. 7. The middle point of the line segment AB is identified as O. The coverage of projections is determined from an area of a circle centered at the point O with a diameter having a length equivalent to that of the line segment AO and an area of the projections existing inside the circle.

At least 100 toner particles are subjected to the above procedure, and the measured values are averaged. The average length of the long side is determined from the lengths of the long sides of at least 100 projections per one toner particle. The area and the length of the long side of the projections are measured with an image analysis particle size measurement software program Mac-View (from Mountech Co., Ltd.). The measurement of the area and the length of the long side of the projections are not limited to the above procedures.

The average length of the long side of the projections is 0.1 μm or more and 0.5 μm or less, preferably 0.3 μm or less. When the average length exceeds 0.5 μm, the projections become scattered on the toner surface to reduce the surface area. As a result, only a smaller amount of the external additives is strongly borne on the toner surface, which is not preferable. The standard deviation of the average length is 0.2 or less, preferably 0.1 or less. When the standard deviation exceeds 0.2, the projections on the toner surface become non-uniform in size, which is not favorable for increasing the surface area. The coverage is from 30% to 90%, preferably from 40% to 80%, and more preferably from 50% to 70%. When the coverage is less than 30% or in excess of 90%, only a smaller amount of the external additives is strongly borne on the toner surface, which is not preferable.

Measurement of Charge Amount

Charge amount is measured with a blow-off device described in JP-3487464-B the disclosure of which is incorporated herein by reference. Specifically, 25 g of a carrier for use in IMAGIO NEO C600 (from Ricoh Co., Ltd.) and 0.05 g of a sample are contained in a polyethylene bottle and mixed by a roll mill for 5 minutes. The resulting mixture in an amount of 2.0 g is set in the blow-off device.

Image Forming Apparatus, Process Cartridge, and Image Forming Method

The image forming apparatus according to an embodiment of the present invention may include a process cartridge containing elements such as a photoconductor, a developing device, and a cleaner, which is detachable from the image forming apparatus. Alternatively, a single unit of process cartridge containing a photoconductor and at least one member selected from a charger, an irradiator, a developing device, a transfer device, a separator, and a cleaner, can be detachably mounted on the image forming apparatus having a guide member, such as rails, for guiding the process cartridge.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Examples 1 to 15 and Comparative Examples 1 to 16

Preparation of Cleaning Blades 1 to 21

A cleaning blade is prepared by dipping an elastic body blade formed of polyurethane in an isocyanate-based treatment liquid for adjusting surface friction coefficient and surface elastic modulus.

More specifically, a cleaning blade is prepared by dipping an elastic body blade formed of polyurethane in a treatment liquid in which an isocyanate component and at least one of a fluorine-based polymer and a silicone-based polymer are dissolved in a solvent, followed by refinement. By changing the amounts of the isocyanate component, fluorine-based polymer, and silicone-based polymer in the treatment liquid, elastic body blades 1 to 21 are prepared as described in Table 1.

Preparation of Cleaning Blade 22

The elastic body blade disclosed in Example 2 of JP-2010-210879-A, the disclosure of which is incorporated herein by reference, is used as a cleaning blade 22. Detailed conditions of the cleaning blade 22 are described below.

Urethane Rubber

An urethane rubber having a hardness of 69 degrees and an impact resilience of 49% (from Toyo Tire & Rubber Co., Ltd.) is used. The hardness of the urethane rubber is measured with a durometer available from Shimadzu Corporation based on a method according to JIS K6253. The measurement sample is a laminate having a thickness of 6 mm or more in which sheets each having a thickness of about 2 mm are laminated.

The impact resilience of the urethane rubber is measured with a resilience tester No. 221 available from Toyo Seiki Kogyo Co., Ltd. based on a method according to JIS K6255. The measurement sample is a laminate having a thickness of 4 mm or more in which sheets each having a thickness of about 2 mm are laminated.

Composition of Impregnating Solution

Isocyanate compound: MR-100 available from Nippon Polyurethane Industry Co., Ltd. (10 parts)

Silicone resin: MODIPER FS-700 available from NOF Corporation (2 parts)

2-Butanone (88 parts)

Composition of Surface Layer

Urethane acrylate oligomer 1: UN-904 available from Negami Chemical Industrial Co., Ltd. (5 parts)

Urethane acrylate oligomer 2: UN-2700 available from Negami Chemical Industrial Co., Ltd. (19.5 parts)

Low friction coefficient additive: Copolymer A1 from JNC Petrochemical Corporation (5 parts)

Polymerization initiator: IRGACURE 184 available from Ciba Specialty Chemicals (1 part)

Solvent: 2-Butanone (74 parts)

Coated film hardness: Pencil hardness H

Friction coefficient: 0.1

Surface elastic modulus: 30 $N/mm^2$

Surface friction coefficient: 0.35

The pencil hardness of the surface layer is measured with a pencil scratch tester KTVF-2380 available from COTEC based on a method according to JIS K5600-5-4. The measurement sample is prepared by spray coating a glass plate having a size of 50 mm×50 mm with the surface layer materials to have a thickness of about 10 μm.

The friction coefficient is a maximum static friction coefficient measured with TRIBOGEAR MUSE TYPE 94i available from Shinto Scientific Co., Ltd. The surface friction coefficient is measured in the above-described manner. The measurement sample is prepared by spray coating a glass plate having a size of 50 mm×50 mm with the coating materials to have a thickness of about 10 μm.

Properties of the cleaning blades 1 to 22 are described in Table 1.

Table 1

| | Rubber Hardness | Surface Elastic Modulus | Surface Friction Coefficient |
|---|---|---|---|
| Blade 1 | 78 | 20 | 0.6 |
| Blade 2 | 78 | 20 | 0.5 |
| Blade 3 | 78 | 20 | 0.7 |
| Blade 4 | 74 | 15 | 0.6 |
| Blade 5 | 74 | 15 | 0.5 |
| Blade 6 | 74 | 15 | 0.7 |
| Blade 7 | 80 | 25 | 0.6 |
| Blade 8 | 80 | 25 | 0.5 |
| Blade 9 | 80 | 25 | 0.7 |
| Blade 10 | 69 | 10 | 0.6 |
| Blade 11 | 69 | 10 | 0.5 |
| Blade 12 | 69 | 10 | 0.7 |
| Blade 13 | 83 | 30 | 0.6 |
| Blade 14 | 83 | 30 | 0.5 |
| Blade 15 | 83 | 30 | 0.7 |
| Blade 16 | 78 | 20 | 0.4 |
| Blade 17 | 78 | 20 | 0.8 |
| Blade 18 | 74 | 15 | 0.4 |
| Blade 19 | 74 | 15 | 0.8 |
| Blade 20 | 80 | 25 | 0.4 |
| Blade 21 | 80 | 25 | 0.8 |
| Blade 22 | 69 | 30 | 0.35 |

Preparation of Toners

Preparation of Toner 1

Preparation of Resin Dispersion 1

In a reaction vessel equipped with a condenser, a stirrer, and a nitrogen inlet pipe, 0.7 parts of sodium dodecyl sulfate are dissolved in 498 parts of ion-exchange water while being stirred and heated to 80° C. Thereafter, a solution in which 2.6 parts of potassium persulfate are dissolved in 104 parts of ion-exchange water is added to the vessel. Fifteen minutes later, a monomer mixture liquid including 170 parts of styrene monomer, 30 parts of butyl acrylate, and 8.2 parts of n-octanethiol is dropped in the vessel over a period of 90 minutes. The temperature is kept at 80° C. for subsequent 60 minutes to cause a polymerization reaction.

The vessel is then cooled to obtain a resin dispersion 1 that is white, containing resin particles having a volume average particle diameter of 53.2 nm. The resin dispersion 1 in an amount of 2 ml is put on a petri dish to vaporize the dispersion solvent. The solid residue has a number average molecular weight of 5,400, a weight average molecular weight of 9,800, and a glass transition temperature (Tg) of 49.4° C.

Preparation of Polyester 1

A reaction vessel equipped with a condenser, a stirrer, and a nitrogen inlet pipe is charged with 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide. The vessel contents are subjected to a reaction at 230° C. for 8 hours under normal pressure. Next, the vessel contents are subjected to a reaction under reduced pressures of 10 to 15 mmHg for 5 hours. After adding 44 parts of trimellitic anhydride to the vessel, the vessel contents are further subjected to a reaction under normal pressure at 180° C. for 2 hours. Thus, a polyester 1 is prepared. The polyester 1 has a number average molecular weight of 2,500, a weight average molecular weight of 6,700, a glass transition temperature (Tg) of 43° C., and an acid value of 25 mgKOH/g.

Preparation of Polyester 2

A reaction vessel equipped with a condenser, a stirrer, and a nitrogen inlet pipe is charged with 264 parts of ethylene oxide 2 mol adduct of bisphenol A, 523 parts of propylene oxide 2 mol adduct of bisphenol A, 123 parts of terephthalic acid, 173 parts of adipic acid, and 1 part of dibutyltin oxide. The vessel contents are subjected to a reaction at 230° C. for 8 hours under normal pressure and subsequent 8 hours under reduced pressures of 10 to 15 mmHg. After adding 26 parts of trimellitic anhydride to the vessel, the vessel contents are further subjected to a reaction at 180° C. for 2 hours under normal pressures. Thus, a polyester 2 is prepared. The polyester 2 has a number average molecular weight of 4,000, a weight average molecular weight of 47,000, a Tg of 65° C., and an acid value of 12.

Preparation of Isocyanate-Modified Polyester 1

A reaction vessel equipped with a condenser, a stirrer, and a nitrogen inlet pipe is charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The vessel contents are subjected to a reaction at 230° C. for 8 hours under normal pressure. Next, the vessel contents are subjected to a reaction under reduced pressures of 10 to 15 mmHg for 5 hours. Thus, an intermediate polyester 1 is prepared. The intermediate polyester 1 has a number average molecular weight of 2,200, a weight average molecular weight of 9,700, a glass transition temperature (Tg) of 54° C., an acid value of 0.5 mgKOH/g, and a hydroxyl value of 52 mgKOH/g.

Another reaction vessel equipped with a condenser, a stirrer, and a nitrogen inlet pipe is charged with 410 parts of the intermediate polyester 1, 89 parts of isophorone diisocyanate, and 500 parts of ethyl acetate. The vessel contents are subjected to a reaction at 100° C. for 5 hours. Thus, an isocyanate-modified polyester 1 is prepared.

Preparation of Master Batch

First, 40 parts of a carbon black (REGAL® 400R from Cabot Corporation), 60 parts of a polyester binder resin (RS-801 from Sanyo Chemical Industries, Ltd., having an acid value of 10, an Mw of 20,000, and a Tg of 64° C.), and 30 parts of water are mixed by a HENSCHEL MIXER to obtain a mixture that is a pigment aggregation into which water is penetrated. The mixture is kneaded with a double roll having a surface temperature of 130° C. for 45 minutes. The kneaded mixture is pulverized into particles having a size of 1 mm by a pulverizer. Thus, a master batch 1 is prepared.

Preparation of Oily Phase

A reaction vessel equipped with a stirrer and a thermometer is charged with 545 parts of the polyester 1, 181 parts of a paraffin wax (having a melting point of 74° C.), and 1,450 parts of ethyl acetate. The vessel contents are heated to 80° C. while being stirred, kept at 80° C. for 5 hours, and cooled to 30° C. over a period of 1 hour. Further, 500 parts of the master batch 1 and 100 parts of ethyl acetate are added to the vessel, and the vessel contents are mixed for 1 hour. Thus, a raw material liquid 1 is prepared.

Thereafter, 1,500 parts of the raw material liquid 1 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 655 parts of a 65% ethyl acetate solution of the polyester 2 are added, and the resulting mixture is subjected to the above dispersing operation once (1 pass). Thus, a colorant wax dispersion 1 is prepared.

The colorant wax dispersion 1 in an amount of 976 parts is stirred with a TK HOMOMIXER (from Primix Corporation) at a revolution of 5,000 rpm for 1 minute. After adding 88 parts of the isocyanate-modified polyester 1 thereto, the resulting mixture is stirred with a TK HOMOMIXER (from Primix Corporation) at a revolution of 5,000 rpm for 1 minute. Thus, an oily phase 1 is prepared. Solid contents account for 52.0% by weight of the oily phase 1. The amount of ethyl acetate is 92% by weight of the solid contents.

Preparation of Aqueous Phase

First, 970 parts of ion-exchange water, 40 parts of a 25% aqueous dispersion liquid of fine organic resin particles (i.e., a copolymer of styrene, methacrylic acid, butyl acrylate, sodium salt of sulfate ester of ethylene oxide adduct of methacrylic acid) for dispersion stability, 95 parts of a 48.5% aqueous solution of dodecyl diphenyl ether sodium disulfonate, and 98 parts of ethyl acetate are mixed by stirring. The resulting mixture has a pH of 6.2. A 10% aqueous solution of sodium hydroxide is added to the mixture to adjust pH to 9.5. Thus, an aqueous phase 1 is prepared.

Preparation of Core Particle

The oily phase 1 is mixed with 1,200 parts of the aqueous phase 1 by a TK HOMOMIXER at a revolution in the range of 8,000 to 15,000 rpm for 2 minutes in a water bath while adjusting the liquid temperature to the range of 20° C. to 23° C. to suppress temperature rise caused by shearing heat from the mixer. The resulting mixture is stirred by a THREE-ONE MOTOR equipped with anchor blades at a revolution in the range of 130 to 350 rpm for 10 minutes. Thus, a core particle slurry 1, in which liquid droplets of the oily phase is dispersed in the aqueous phase, is prepared.

Formation of Projections

While stirring the core particle slurry 1 by a THREE-ONE MOTOR equipped with anchor blades at a revolution in the range of 130 to 350 rpm and adjusting the liquid temperature to 22° C., a mixture of 106 parts of the resin dispersion 1 and 71 parts of ion-exchange water (containing 15% of solid contents) is dropped in the core particle slurry 1 over a period of 3 minutes. Thereafter, the revolution is changed to the range of 200 to 450 rpm and the stirring is continued for 30 minutes. Thus, a composite particle slurry 1 is prepared. The composite particle slurry 1 in an amount of 1 ml is diluted into 10 ml and subjected to centrifugal separation. The resulting supernatant liquid is transparent.

Solvent Removal

The composite particle slurry 1 is contained in a vessel equipped with a stirrer and a thermometer and subjected to solvent removal at 30° C. for 8 hours while being stirred. Thus, a dispersion slurry 1 is prepared. A small amount of the dispersion slurry 1 is put on a glass slide, covered with a cover glass, and observed with an optical microscope at a magnification of 200 times. As a result, uniform colored particles are observed. The dispersion slurry 1 in an amount of 1 ml is diluted into 10 ml and subjected to centrifugal separation. The resulting supernatant liquid is transparent.

Washing and Drying Process

After filtering 100 parts of the dispersion slurry 1 under reduced pressures:

(1) 100 parts of ion-exchange water are added to the resulting filter cake, and they are mixed by a TK HOMOMIXER at a revolution of 12,000 rpm for 10 minutes, followed by filtering;

(2) 900 parts of ion-exchange water are added to the filter cake obtained in (1), and they arc mixed by a TK HOMOMIXER at a revolution of 12,000 rpm for 30 minutes while applying ultrasonic vibration thereto, followed by filtering. This operation is repeated until the re-slurry liquid exhibits an electric conductivity of 10 μS/cm or less;

(3) A 10% solution of hydrochloric acid is added to the re-slurry liquid obtained in (2) until the re-slurry liquid exhibits a pH of 4. The mixture is stirred by a THREE-ONE MOTOR for 30 minutes, followed by filtering; and (4) 100 parts of ion-exchange water are added to the filter cake obtained in (3), and they are mixed by a TK HOMOMIXER at a revolution of 12,000 rpm for 10 minutes, followed by filtering. This operation is repeated until the re-slurry liquid exhibits an electric conductivity of 10 μS/cm or less. Thus, a filter cake 1 is obtained.

The filter cake 1 is dried by a circulating air dryer at 45° C. for 48 hours and then filtered with a mesh having openings of 75 μm. Thus, a mother toner 1 is prepared. As a result of an observation of the mother toner 1 with a scanning electron microscope, it is confirmed that the vinyl resin particles are uniformly adhered to the surface of the core particle.

The mother toner 1 in an amount of 100 parts is mixed with external additives in accordance with conditions described in Tables 2 and 3 by a HENSCHEL MIXER for 10 minutes. The resulting mixture is passed through a sieve having an opening of 60 μm to remove coarse particles and aggregates. Thus, a toner 1 is prepared.

TABLE 2

| External Additive | External Additive No. | | | | | | | Mixing Time |
|---|---|---|---|---|---|---|---|---|
| Condition No. | 1 | 2 | 3 | 4 | 5 | 6 | 7 | (min) |
| 1 | 1.0 | 1.0 | 0.0 | 0.0 | 0.0 | 0.0 | 0.0 | 10 |
| 2 | 1.0 | 0.0 | 1.0 | 0.0 | 0.0 | 0.0 | 0.0 | 10 |
| 3 | 1.0 | 0.0 | 0.0 | 1.0 | 0.0 | 0.0 | 0.0 | 10 |
| 4 | 1.0 | 0.0 | 0.0 | 0.0 | 1.0 | 0.0 | 0.0 | 10 |
| 5 | 0.5 | 0.5 | 0.0 | 0.0 | 0.0 | 0.0 | 0.0 | 10 |
| 6 | 2.0 | 5.0 | 0.0 | 0.0 | 0.0 | 0.0 | 0.0 | 10 |
| 7 | 1.0 | 0.0 | 0.0 | 0.0 | 0.0 | 0.0 | 0.0 | 10 |
| 8 | 1.0 | 0.0 | 0.0 | 0.0 | 0.0 | 1.0 | 0.0 | 10 |
| 9 | 1.0 | 0.0 | 0.0 | 0.0 | 0.0 | 0.0 | 1.0 | 10 |

TABLE 3

| | Mother Toner | External Additive Condition No. | External Additive Content |
|---|---|---|---|
| Toner 1 | Mother Toner 1 | 1 | 1.95 |
| Toner 2 | Mother Toner 1 | 2 | 1.95 |
| Toner 3 | Mother Toner 1 | 3 | 1.93 |
| Toner 4 | Mother Toner 1 | 4 | 1.92 |
| Toner 5 | Mother Toner 1 | 5 | 0.96 |
| Toner 6 | Mother Toner 1 | 6 | 6.84 |
| Toner 7 | Mother Toner 2 | 1 | 1.96 |
| Toner 8 | Mother Toner 1 | 7 | 0.98 |
| Toner 9 | Mother Toner 1 | 8 | 1.97 |
| Toner 10 | Mother Toner 1 | 9 | 1.95 |

The external additives 1 to 7 listed in Table 2 are as follows.

External Additive 1: RX100 having a particle diameter of 12 nm available from Nippon Aerosil Co., Ltd.

External Additive 2: MSN-006 having a particle diameter of 80 nm available from Tayca Corporation External Additive 3: H05TM having a particle diameter of 50 nm available from Clariant Japan K.K.

External Additive 4: MP-400 9S having a particle diameter of 300 nm available from Soken Chemical & Engineering Co., Ltd.

External Additive 5: MSP-009 having a particle diameter of 80 nm available from Tayca Corporation External Additive 6: RX50 having a particle diameter of 40 nm available from Nippon Aerosil Co., Ltd.

External Additive 7: MP-5500 having a particle diameter of 430 nm available from Soken Chemical & Engineering Co., Ltd.

Preparation of Toners 2 to 10

Preparation of Mother Toner 2

The procedure in Preparation of Toner 1 is repeated except for eliminating the process "Formation of Projections". Thus, a mother toner 2 is obtained. As a result of an observation of the mother toner 2 with a scanning electron microscope, it is confirmed that no projection is formed on the surface of the core particle.

The mother toner 1 or 2 in an amount of 100 parts is mixed with external additives in accordance with conditions described in Tables 2 and 3 by a HENSCHEL MIXER for 10 minutes. The resulting mixture is passed through a sieve having an opening of 60 μm to remove coarse particles and aggregates. Thus, toners 2 to 10 are prepared.

The toners 1 to 10 are subjected to quantitative determination of the external additives in the above-described manner. The results are shown in Table 3.

Evaluations

Examples and Comparative Examples shown in Table 4 are subjected to evaluations in terms of the following perspectives.

Defective Cleaning

Each combination of toner and cleaning blade is mounted on a process cartridge of IPSIO SPC730 (from Ricoh Co., Ltd.) to perform a running test. In the running test, an image having a printing rate of 2% is printed on an A4-size sheet in a transverse direction every 20 seconds while changing the temperature and humidity as follows: 23° C./50%→27° C./80%→10° C./15%→27° C./80%. The image is printed on 3,000 sheets with each color toner, i.e., 12,000 sheets in total. After the running test, a halftone image is printed on a whole surface of an A4-size sheet, and visually observed to determine whether black lines are generated or not.

Adherence of External Additives to Photoconductor

Each combination of toner and cleaning blade is mounted on a process cartridge of IPSIO SPC730 (from Ricoh Co., Ltd.) to perform a running test. In the running test, an image having a printing rate of 2% is printed on an A4-size sheet in a transverse direction every 20 seconds while changing the temperature and humidity as follows: 23° C./50%→27° C./80%→10° C./15%→27° C./80%. The image is printed on 3,000 sheets with each color toner, i.e., 12,000 sheets in total. After the running test, a halftone image is printed on a whole surface of an A4-size sheet, and visually observed to determine whether white spots are generated or not.

Photoconductor Abrasion

Each combination of toner and cleaning blade is mounted on a process cartridge of IPSIO SPC730 (from Ricoh Co., Ltd.) to perform a running test. In the running test, an image having a printing rate of 2% is printed on an A4-size sheet in a transverse direction every 20 seconds while changing the temperature and humidity as follows: 23° C./50%→27° C./80%→10° C./15%→27° C./80%. The image is printed on 3,000 sheets with each color toner, i.e., 12,000 sheets in total. Before and after the running test, the thickness of the protective layer of the photoconductor is subjected to a measurement with an eddy-current type film thickness measuring system FISCHERSCOPE MMS available from Fischer Instruments K.K. Japan to determine the amount of abrasion of the photoconductor.

Evaluation results are shown in Table 4.

TABLE 4

| | Cleaning Blade | Toner | Defective Cleaning | Adherence of External Additives to Photoconductor | Photoconductor Abrasion |
|---|---|---|---|---|---|
| Example 1 | Blade 1 | Toner 1 | No | No | No |
| Example 2 | Blade 2 | Toner 1 | No | No | No |
| Example 3 | Blade 3 | Toner 1 | No | No | No |
| Example 4 | Blade 4 | Toner 1 | No | No | No |
| Example 5 | Blade 5 | Toner 1 | No | No | No |
| Example 6 | Blade 6 | Toner 1 | No | No | No |
| Example 7 | Blade 7 | Toner 1 | No | No | No |
| Example 8 | Blade 8 | Toner 1 | No | No | No |
| Example 9 | Blade 9 | Toner 1 | No | No | No |
| Example 10 | Blade 1 | Toner 2 | No | No | No |
| Example 11 | Blade 1 | Toner 3 | No | No | No |
| Example 12 | Blade 1 | Toner 4 | No | No | No |
| Example 13 | Blade 1 | Toner 5 | No | No | No |
| Example 14 | Blade 1 | Toner 6 | No | No | No |
| Example 15 | Blade 1 | Toner 7 | No | No | No |
| Comparative Example 1 | Blade 10 | Toner 1 | Yes | No | Yes |
| Comparative Example 2 | Blade 11 | Toner 1 | Yes | No | Yes |
| Comparative Example 3 | Blade 12 | Toner 1 | Yes | No | Yes |
| Comparative Example 4 | Blade 13 | Toner 1 | Yes | Yes | No |
| Comparative Example 5 | Blade 14 | Toner 1 | Yes | Yes | No |
| Comparative Example 6 | Blade 15 | Toner 1 | Yes | Yes | No |
| Comparative Example 7 | Blade 16 | Toner 1 | Yes | No | No |
| Comparative Example 8 | Blade 17 | Toner 1 | Yes | No | No |
| Comparative Example 9 | Blade 18 | Toner 1 | Yes | No | No |
| Comparative Example 10 | Blade 19 | Toner 1 | Yes | No | No |
| Comparative Example 11 | Blade 20 | Toner 1 | Yes | No | No |
| Comparative Example 12 | Blade 21 | Toner 1 | Yes | No | No |
| Comparative Example 13 | Blade 22 | Toner 1 | No | Yes | Yes |
| Comparative Example 14 | Blade 1 | Toner 8 | Yes | Yes | No |
| Comparative Example 15 | Blade 1 | Toner 9 | Yes | Yes | No |
| Comparative Example 16 | Blade 1 | Toner 10 | Yes | No | No |

The evaluation results show that, in accordance with some embodiments of the present invention, an image forming apparatus which provides high-quality image while preventing the occurrence of defective cleaning under various usage environments can be provided.

What is claimed is:

1. An image forming apparatus, comprising:

an image bearer;

a charger to charge a surface of the image bearer;

an irradiator to irradiate the charged surface of the image bearer with light to form an electrostatic latent image thereon;

a developing device to develop the electrostatic latent image with a toner to form a toner image, the toner including:

a mother particle including a binder resin and a colorant; and one or more external additives, at least one of the external additives including primary particles having a number average particle diameter in the range of 0.05 to 0.30 μm;

a transfer device to transfer the toner image onto a transfer medium; and a cleaner to remove toner particles remaining on the image bearer without being transferred, the cleaner including:

an elastic body blade, the elastic body blade having a contact part with the image bearer, the contact part having a surface elastic modulus in the range of 15 to 25 $N/mm^2$ and a surface friction coefficient in the range of 0.5 to 0.7.

2. The image forming apparatus according to claim 1, wherein the elastic body blade is a polyurethane material having been dipped in an isocyanate-based treatment liquid.

3. The image forming apparatus according to claim 1, wherein an angle between a tangent line at the contact part of the elastic body blade with the image bearer in the direction of rotation of the image bearer and a cut surface edge surface of the elastic body blade is from 77° to 82°.

4. The image forming apparatus according to claim 1, wherein the elastic body blade contacts the image bearer with a linear pressure contact pressure in the range of 30 to 70 N/m.

5. The image forming apparatus according to claim 1, wherein the elastic body blade has a JIS-A hardness in the range of 74 to 80 degrees.

6. The image forming apparatus according to claim 1, wherein a content of the external additive including primary particles having a number average particle diameter in the range of 0.05 to 0.30 μm is from 0.5 to 5.0 parts by weight based on 100 parts by weight of the mother particle.

7. The image forming apparatus according to claim 1, wherein a content of the one or more external additives is from 1.0 to 7.0 parts by weight based on 100 parts by weight of the mother particle.

8. The image forming apparatus according to claim 1, wherein at least one of the one or more external additives has a charging polarity opposite to a polarity of the mother particle.

9. The image forming apparatus according to claim 1, wherein at least one of the one or more external additives includes a silicone oil.

10. A process cartridge, comprising:

an image bearer;

at least one member selected from the group consisting of:

a charger to charge a surface of the image bearer;

a developing device to develop an electrostatic latent image formed by irradiating the charged surface of the image bearer with a toner to form a toner image, the toner including: a mother particle including a binder resin and a colorant; and one or more external additives, at least one of the external additives including primary particles having a number average particle diameter in the range of 0.05 to 0.30 μm; and a transfer device to transfer the toner image onto a transfer medium; and a cleaner to remove toner particles remaining on the image bearer without being transferred, the cleaner including an elastic body blade, the elastic body blade having a contact part with the image bearer, the contact part having a surface elastic modulus in the range of 15 to 25 $N/mm^2$ and a surface friction coefficient in the range of 0.5 to 0.7.

* * * * *